US005481872A

United States Patent [19]

Karakama et al.

[11] Patent Number: 5,481,872

[45] Date of Patent: Jan. 9, 1996

[54] HYDRAULIC CIRCUIT FOR OPERATING PLURAL ACTUATORS AND ITS PRESSURE COMPENSATING VALVE AND MAXIMUM LOAD PRESSURE DETECTOR

[75] Inventors: Tadao Karakama, Musashino; Teruo Akiyama, Utsunomiya; Kouji Yamashita, Yokohama; Naoki Ishizaki, Tochigi, all of Japan

[73] Assignee: Kabushiki Kaisha Komatsu Seisakusho, Tokyo, Japan

[21] Appl. No.: 244,439

[22] PCT Filed: Nov. 25, 1992

[86] PCT No.: PCT/JP92/01540

§ 371 Date: Sep. 23, 1994

§ 102(e) Date: Sep. 23, 1994

[87] PCT Pub. No.: WO93/11364

PCT Pub. Date: Jun. 10, 1993

[30] Foreign Application Priority Data

| | | | |
|---|---|---|---|
| Nov. 25, 1991 | [JP] | Japan | 3-334592 |
| Dec. 24, 1991 | [JP] | Japan | 3-355647 |
| Dec. 24, 1991 | [JP] | Japan | 3-355649 |
| Dec. 24, 1991 | [JP] | Japan | 3-355650 |
| Dec. 24, 1991 | [JP] | Japan | 3-355651 |
| Mar. 30, 1992 | [JP] | Japan | 4-102548 |

[51] Int. Cl.[6] ..... F16D 31/02; F15B 11/08

[52] U.S. Cl. ..... 60/421; 60/426; 60/428; 60/494; 60/457; 91/517; 91/518; 91/445; 91/447

[58] Field of Search ..... 91/511, 517, 518, 91/521, 445, 446, 447; 60/420, 421, 422, 426, 428, 468, 452, 494, 445

[56] References Cited

U.S. PATENT DOCUMENTS

| | | | |
|---|---|---|---|
| 5,005,358 | 4/1991 | Hirata et al. | 60/426 |
| 5,083,428 | 1/1992 | Kubomoto et al. | 60/422 X |
| 5,146,747 | 9/1992 | Sugiyama et al. | 91/446 X |
| 5,161,373 | 11/1992 | Morikawa et al. | 91/446 X |

FOREIGN PATENT DOCUMENTS

| | | |
|---|---|---|
| 62-88803 | 4/1987 | Japan . |
| 1-216174 | 8/1989 | Japan . |
| 59-197603 | 11/1989 | Japan . |
| 2-49405 | 10/1992 | Japan . |

*Primary Examiner*—F. Daniel Lopez
*Assistant Examiner*—Hoang Nguyen
*Attorney, Agent, or Firm*—Richards, Medlock & Andrews

[57] ABSTRACT

Simultaneous operation efficiency in a case where a plurality of actuators are operated by one or a plurality of hydraulic pumps is improved. A delivery pressure passage (1*a*) of one hydraulic pump (1) and that (1*a*) of the other hydraulic pump (1) communicate with each other through a first short-circuit passage (39) via a pair of check valves (38, 38), and an unload valve (40) is provided in this first short-circuit passage (39). The load pressure introduction passages (6, 6) on the left and right hydraulic pumps (1, 1) communicate with each other through a second short-circuit passage (36) via a pair of check valves (35, 35), and a relief valve (37) is provided in this short-circuit passage (36). The unload valve (40) is unloaded by the differential pressure between the pump delivery pressure in the first short-circuit passage (39) and the load pressure in the second short-circuit passage (36), whereby a single relief valve (37) carries out a relieving operation both at the time of flow merging and at the time of flow branching to equalize the maximum pump delivery pressures. The set pressure of the relief valve (37) can be a high level so as to relieve the valve (37) under a predetermined high load pressure, whereby the relieving operation can be arbitrarily controlled.

23 Claims, 16 Drawing Sheets

HYDRAULIC CIRCUIT FOR OPERATING PLURAL ACTUATORS AND ITS PRESSURE COMPENSATING VALVE AND MAXIMUM LOAD PRESSURE DETECTOR

FIELD OF THE INVENTION

The present invention relates to a hydraulic circuit for operating a plurality of actuators by supplying the delivery pressure oil of a single pump or a plurality of pumps to the plurality of actuators, a pressure compensating valve for distributing the delivery pressure oil of the pump or pumps in accordance with the opening of each operating valve, and a maximum load pressure detector for detecting the maximum load pressure of a plurality of actuators in the hydraulic circuit and using it as a pilot pressure for controlling the discharge of the pump or pumps and the pressure compensating valve, in a hydraulic excavator or the like.

BACKGROUND ART

A generally employed hydraulic circuit for simultaneously driving a plurality of actuators of a construction machine or the like, has all pressure compensating valves set in accordance with the maximum load pressure of the plurality of actuators when a plurality of operating valves are simultaneously operated, thereby making it possible to distribute the oil flow to the plurality of actuators in accordance with the opening area ratio of each operating valve even if the load pressures of the plurality of actuators differ.

In such a hydraulic circuit, when a plurality of actuators are simultaneously operated, the respective pressure compensating valves are set in accordance with the maximum load pressure, and the delivery pressure of the hydraulic pump becomes slightly higher than the set pressure. Therefore, the pressure loss in a pressure compensating valve of an actuator, wherein there is a significant difference between the maximum load pressure and the load pressure of the actuator, becomes high, resulting in a great horsepower loss for the prime mover which drives the hydraulic pump and an increased temperature of the hydraulic oil with consequent quickened deterioration of the hydraulic oil. For instance, when pressurized oil is supplied to a boom cylinder and a swinging motor of a power shovel to lower the boom and to swing the upper body of the power shovel at the same time, the load pressure of the boom is low because the boom lowers automatically due to gravity, while the load pressure of the swinging motor is high because the motor starts and accelerates the upper body, and the pump delivery pressure becomes slightly higher than a set pressure. Therefore, the difference between the high load pressure of the swing motor and the low load pressure of the boom cylinder causes a pressure loss in the pressure compensating valve on the boom cylinder side, resulting in a great pressure loss since the difference in load pressures is great as previously mentioned.

A prior art hydraulic circuit is shown in FIG. 12. More specifically, in FIG. 12, a delivery circuit 1*a* of a left pump 1 and a delivery circuit 1*a* of a right pump 1 can be connected together through a flow merging and branching valve 176. A load pressure introduction conduit 178*a* of a pressure compensating valve 5 of an operating valve 2, which is connected to the delivery circuit 1*a* of the left pump 1, and a load pressure introduction conduit 178*b* of the pressure compensating valve 5 of the operating valve 2, which is connected to the delivery circuit 1*a* of the right pump 1, are connected through a flow merging and branching valve 177. The delivery circuits 1*a*, 1*a* and the load introduction conduits 178*a*, 178*b*, are made independent by the flow merging and branching valves 176, 177 so that when an actuator 3*a*, connected to the left delivery circuit 1*a*, and an actuator 3*b*, connected to the right delivery circuit 1*a*, are operated simultaneously, the pressure compensating valve 5 is set in accordance with the load pressures of both actuators, thereby reducing the pressure loss.

In such a hydraulic circuit, however, delivery pressures $P_1$, $P_2$ of the pumps are controlled based on a load pressure $P_{LS}$, so that they are slightly higher than the load pressure. Therefore, merely providing the delivery passages 1*a*, 1*a* of the pumps with relief valves may not allow the hydraulic circuit to exhibit the function thereof. An example of a solution for such problem is a hydraulic circuit, shown in FIG. 13, wherein the delivery circuits 1*a*, 1*a* of the right and left pumps 1, 1 are provided with unload valves 170, and the load pressure introduction passages 178*a*, 178*b* are provided with relief valves 171 so that the unload valves 170 are unloaded when the pump delivery pressure $P_1$ exceeds the load pressure $P_{LS}$ by the aforesaid set pressure or more.

In such a hydraulic circuit, when the load pressure $P_{LS}$, of the load pressure introduction passages 178*a*, 178*b* exceeds the set pressure of the relief valve 171, the relief valve 171 carries out a relieving operation, causing a part of the load pressure $P_{LS}$ to flow out into a reservoir tank. When the load pressure $P_{LS}$ decreases to cause the differential pressure between itself and the pump delivery pressure $P_1$ to exceed the aforesaid set pressure, the unload valve 170 unloads so as to let a part of the pump delivery pressure $P_1$ flow into the tank, thus limiting the maximum pump delivery pressure.

However, in the hydraulic circuit shown in FIG. 13, the maximum pump delivery pressure, which is produced when the delivery pressure oils of the right and left pumps 1, 1 are merged and supplied to the actuators, is different from that at the time of flow branching when the delivery pressure oil of either the left pump 1 or the right pump 1 is independently supplied to the actuators.

Specifically, at the time of flow merging, the right and left load pressure introduction passages 178*a*, 178*b* are connected, and therefore, when the load pressure $P_{LS}$ exceeds the set pressure of the relief valve 171, a part of the load pressure from the two relief valves 171, 171 flows out into the tank. At the time of flow branching, the first and second load pressure introduction passages 178*a*, 178*b* are separated; and therefore, when the load pressure $P_{LS}$, exceeds the set pressure of the relief valves 171, a part of the load pressure flows into the tank through only one relief valve 171. The relief flow rate for the load pressure $P_{LS}$ will be as shown in FIG. 14, resulting in a different load pressure when the differential pressure (between the pump delivery pressure and the load pressure), at which the unload valve 170 unloads, is reached.

For example, at the time of flow merging, the relief flow rate is large, as shown by a in FIG. 14, since the load pressure is released from both right and left relief valves 171, 171, and therefore a predetermined relief flow rate is reached at a low load pressure $P_{LS1}$ . At the time of flow branching, a load pressure $P_{LS2}$, at which the aforesaid relief flow rate is reached, becomes high because the relief flow rate is determined by the override characteristic (b of FIG. 14) of the relief valve 171.

Hence, the maximum pump delivery pressure of the pump at the time of flow merging equals $P_{LS1}$ plus the unload differential pressure, while the maximum pump delivery pressure at the time of flow branching equals $P_{LS2}$ plus the unload differential pressure, the maximum pump delivery pressure at the time of flow branching being higher by $P_{LS2}$ $-P_{LS1}$. This poses a first problem in that, if the rated pressure is set to the maximum pump delivery pressure at the time of flow merging when designing the hydraulic circuit, then the rated pressure is exceeded at the time of flow branching, adversely affecting the service life of the hydraulic equipment, including pumps, circuits, and actuators; if the rated pressure is set at the maximum pump delivery pressure at the time of flow branching, then the rated pressure is not reached at the time of flow merging, leading to deteriorated performance of the actuators.

Another known hydraulic circuit, which has a pressure compensating valve, for use in a construction machine is disclosed in Japanese Published Unexamined Patent Application (A) 62-88803. More specifically, a hydraulic circuit is known wherein a plurality of closed-center operating valves are disposed in the delivery passage of the pump, pressure compensating valve are provided in a connecting circuit of the operating valves and the actuators, the maximum pressure at the load pressure of each actuator is detected by a shuttle valve or a check valve, and the load pressure is supplied to a spring compartment of each pressure compensating valve, thus producing the set pressure for that particular load pressure.

In such a hydraulic circuit, the pressure compensation is set in accordance with the maximum pressure at the load pressure of the plurality of actuators when the plurality of operating valves are operated simultaneously, thus making it possible to distribute the rate of flow to the plurality of actuators in accordance with the opening area ratios of the operating valves even if the load pressures of the plurality of actuators differ.

Such a hydraulic circuit is provided with a load sensing (LS) valve which controls the tilt of a swash plate of a hydraulic pump in accordance with the differential pressure between the pump delivery pressure of the hydraulic pump and the load pressure, so that the pump delivery pressure is higher than the load pressure only by the aforesaid differential pressure.

On the other hand, if the actuator reaches a stroke end or a significantly high load is applied to the actuator with a resultant extremely high load pressure, then the pump delivery pressure increases accordingly, adversely affecting the service life of the hydraulic equipment. For this reason, the pump delivery pressure is permitted to flow to the reservoir tank, namely, it is relieved, in order to limit the pump delivery pressure.

At the time of the relief, the differential pressure between the pump delivery pressure and the load pressure tends to grow larger than the differential pressure set by the LS valve mentioned above; therefore, the swash plate of the hydraulic pump is automatically set at a minimum swash plate angle, that is, it is set to a cutoff state to minimize the discharge of the hydraulic pump. This causes the relief flow rate to decrease, permitting a reduction in the relief loss.

There is a second problem, however, in that there is normally a time delay of 0.2 to 0.4 second before the swash plate reaches the minimum swash plate angle when the aforesaid load pressure drops from the extremely high level to the low level at which the relief is no longer carried out, and a shortage in the discharge of the hydraulic pump occurs during the delay period.

For example, in the case of the hydraulic circuit for an excavator, such as a power shovel, when a rock is dug up by a bucket during excavation, the load on a bucket cylinder increases markedly and the relieving operation is carried out to set the hydraulic pump at the minimum swash plate angle; when the bucket scoops the rock, which has been dug up, the load on the bucket cylinder grows smaller, causing the relieving operation to stop; and at this time, there is a time delay before the swash plate completes the move from the minimum swash plate angle to a required swash plate angle, resulting in inadequate power to the bucket. This makes an operator erroneously feel that the excavator has a smaller excavating power than its true power.

Further in FIG. 12, a load pressure detecting port 2*a* of each of the operating valves 2 communicates with a plurality of shuttle valves 160, and the load pressures of the actuators 3*a* and 3*b* are compared to detect the higher load pressure.

An example of a known configuration of the plurality of shuttle valves 160 mentioned above is disclosed in the Japanese Published Unexamined Patent Application (A) 1-216174 and is shown in FIG. 15.

Specifically, in FIG. 15, a plurality of mounting holes 181 and communicating holes 182 for communicating adjoining mounting holes 181 are formed in a valve main body 180. Shuttle valve main bodies 183 are fitted into the mounting holes 181. A first inlet port 184, which opens to the mounting hole 181, and a second inlet port 185, which opens to one communicating hole 182, and a second outlet port 186, which opens to the other communicating hole 182, are formed in the shuttle valve main body 183. A ball 187, which communicates either the first inlet port 184 or the second inlet port 185 with the outlet port 186 by means of a working fluid is provided, thus constituting the shuttle valve 160.

In such a shuttle valve 160, when the pressure of the working fluid flowing into the left communicating hole 182 is $P_0$, the pressure of the working fluid flowing into the first inlet port 184 of the left shuttle valve 160 is $P_1$, and the pressure of the working fluid flowing into the first inlet port 184 of the right shuttle valve 160 is $P_2$, then $P_0 < P_1 < P_2$, the pressure of the working fluid flowing into the first inlet port 184 of the right shuttle valve 160, which is the maximum pressure $P_2$, is outputted to the right communicating hole ! 82.

However, a third problem is posed by the shuttle valve apparatus mentioned above in that the communicating hole 182 crosses with mounting hole 181 at a right angle, and the communicating hole 182 and the second inlet port 185 are communicated, as shown in FIG. 16, through an axial notch 189 which is formed in the periphery of the shuttle valve main body 183; therefore, the dimension of the shuttle valve main body 183 prevents the communicating area from being made large enough, leading to a large pressure loss. In addition, the working fluid on the first inlet port 184 side and the working fluid of the communicating hole 182 are sealed except for the gap between the mounting hole 181 and the shuttle valve main body 183, and the sealing effect is inadequate, causing the working fluid, which is outputted, to leak toward the lower pressure side. This leakage of the outputted working fluid and the large pressure loss mentioned above adversely affect the control accuracy.

Furthermore, to supply the delivery pressure oil of a single hydraulic pump to a plurality of hydraulic actuators, a delivery passage from the hydraulic pump is provided with a plurality of operating valves and the pressure oil is supplied to all of the hydraulic actuators by switching the operating valves. In this method, however, when the pressurized oil is supplied simultaneously to the plurality of hydraulic actuators, the pressurized oil is supplied only to the hydraulic actuators with smaller load and the pressurized oil is not supplied to the hydraulic actuators with larger load.

A pressure-compensating hydraulic circuit, disclosed in Japanese Published Examined Patent Application (B2) 2-49405, has been proposed as a solution for the problem described above.

The schematic diagram of a pressure-compensating hydraulic circuit is shown in FIG. 17. Specifically, the delivery passage 1*a* of the hydraulic pump 1 is provided with a plurality of operating valves 2; and the circuits 4, which connect the operating valves 2 and hydraulic actuators 3, are provided with pressure compensating valves 5. The pressure of each circuit 4, that is, the maximum pressure under the load pressure, is detected by a load pressure detecting passage 161 through check valves 160*a*, 160*a*, and the detected load pressure is caused to act on a pressure receiving section 5*a* of each pressure compensating valve 5 in order to set a pressure, which matches the load pressure, to equalize the outlet pressures of all of the operating valves 2 so that, when the operating valves 2 are actuated at the same time, the pressurized oil can be supplied to all the hydraulic actuators 3 according to flow branching ratios, which are proportional to the opening areas of the individual operating valves 2.

In such a pressure-compensating hydraulic circuit, the function of the pressure compensating valves 5 allows the rate of flow to be distributed in proportion to the opening areas of the operating valves 2 independently of the magnitude of the load of the hydraulic actuators 3, making it possible to distribute and supply the delivery pressure oil of the single hydraulic pump 1 to the respective hydraulic actuators 3 in proportion to the operating amounts of the operating valves 2.

According to the hydraulic circuit described above, each pressure compensating valve 5 is set in accordance with the highest load pressure as previously mentioned; therefore, when, for instance, the pressure oil is supplied simultaneously to the power shovel swinging motor and the boom cylinder to lift the boom while swinging the upper body of the power shovel, the starting torque of the swinging motor grows markedly high in the early stage of swinging, causing an extremely high load pressure, and all the pressure compensating valves 5 are set under that extremely high load pressure. This leads to a reduction in the passing flow rate, and the flow which can be supplied to the boom cylinder decreases accordingly, causing a significant decrease in the boom lifting speed and also an increase in the pressure loss in the pressure compensating valves 5.

For this reason, a circuit connected to the load pressure detector of the swinging motor was conventionally provided with a switch valve. The switch valve is closed when supplying the pressurized oil to an actuator other than the swinging motor, so that the load pressure of the swinging motor is not detected, ensuring that the pressure compensating valves are set in accordance with the load pressures of other actuators.

However, there is a fourth problem in that, if the switch valve is opened or closed to detect or not to detect the load pressure of the swinging motor, then the maximum load pressure suddenly changes each time the switch valve is opened or closed. This in turn causes the set pressures of the pressure compensating valves to change abruptly and the passing flow rate to also change suddenly, leading to a sudden change in the flow rate into the actuators with resultant occurrence of a shock.

Further, the applicant proposed in the past the load pressure detector in the pressure-compensating hydraulic circuit shown in FIGS. 18 and 19. As shown in FIGS. 18 and 19, a valve main body 130 is formed with a pair of output ports 132, 132, a pair of pump ports 133, 133, a pair of actuator ports 134,134, and a pair of tank ports 135, 135 located on right and left sides of a spool hole 131*a*. A load pressure detection port 136 is formed at a lateral midpoint of the spool hole 131*a*. The load pressure detection port 136 is connected by a check valve 137 to a load pressure detection port 138, which serves as the load pressure detecting circuit. A pair of first small-diameter sections 140, 140 and a pair of second small-diameter sections 141, 141 are formed on right and left sides of a spool 139*a*, which is fitted in the spool hole 131*a*, to constitute an operating valve 2. An output port 132 is connected by a pressure compensating valve 5 to the respective actuator port 134. The spool 139*a* is provided with a pair of right and left load pressure detecting holes 142, 142, with each load pressure detecting hole 142 being opened to a first small-diameter section 140 through a first port 143, opened to a load pressure detection port 136 through a second port 144, and opened to an actuator port 134 through a third port 146 via a ball 145. As shown in FIG. 19, when the spool 19*a* is in the operating position, the pressure of one output port 132 can flow as the load pressure into a load pressure detection port 136 through a first port 143, a load pressure detecting hole 142, and a second port 144.

However, in a configuration such as shown in FIG. 19, a part of the load pressure, which flows into the load pressure detection port 136 when the operating stroke of the spool 139*a* is small, flows out into the tank port 135 on the opposite side through a circular groove 147, a groove 147*a*, a second port 144, the load pressure detecting hole 142, the ball 145, and a drain port 148. Therefore, the detected load pressure is decreased below the pressure of the output port 132, and the delivery flow rate of the hydraulic pump 1 decreases, thus making it possible to prevent the shock in the fine operating area of the operating valve 2. In other words, the delivery flow rate of the hydraulic pump 1 is controlled by utilizing the pump delivery pressure so that the differential pressure between the pump delivery pressure and the load pressure stays constant. As the detected load pressure decreases, the delivery flow rate decreases, and therefore, the delivery flow rate can be reduced by decreasing the load pressure.

However, there is a fifth problem in that, when the spool 139*a* is located in a neutral position shown in FIG. 18, the pressurized oil of the actuator port 134 based on the holding pressure of the hydraulic actuator 3 leaks not only through the clearance gap between the spool hole 131 and the spool 139*a* into the pump port 133 and the tank port 135, as shown by the arrows, but also through the third port 146 to the tank port 135 via the drain port 148, as shown by the arrows, causing the pressurized oil on the holding pressure side of the hydraulic actuator 3 to flow out, and the hydraulic actuator 3 may be moved by an external force.

In addition, as the hydraulic circuit for simultaneously driving a plurality of actuators such as in a construction machine or the like, there has been proposed, for example, in Japanese Published Examined Patent Application (B2) 2-49405, a hydraulic circuit as shown in FIG. 17, wherein all pressure compensating valves are set in accordance with the maximum load pressure of the plurality of actuators when a plurality of operating valves are actuated at the same time, and the flow rate is distributed to the plurality of actuators in accordance with the opening area ratios of the operating valves even if the load pressures of the plurality of actuators differ.

In FIG. 17, the delivery passage 1*a* of the hydraulic pump 1 is provided with a plurality of operating valves 2; and the circuits 4, which connect the operating valves 2 and the hydraulic actuators 3, are provided with the pressure compensating valves 5. The pressure of each circuit 4, that is, the maximum pressure under the load pressure, is detected by a load pressure detecting passage 161 through check valves 160*a*, and the detected load pressure is caused to act on the pressure receiving section 5*a* of each pressure compensating valve 5 in order to set a pressure, which matches the load pressure, to equalize the outlet pressures of the operating valves 2 so that, when the operating valves 2 are actuated at the same time, the pressurized oil can be supplied to the hydraulic actuators 3 according to the flow branching ratios, which are proportional to the opening areas of the individual operating valves 2. In such a hydraulic circuit, the function of the pressure compensating valves 5 allows the flow rate to be distributed in proportion to the opening areas of the operating valves 2 independently of the magnitude of the load of the hydraulic actuators 3, making it possible to distribute and supply the delivery pressure oil of the single hydraulic pump 1 to the respective hydraulic actuators 3 in proportion to the operating amounts of the operating valves 2.

The pressure compensating valves 5 of FIG. 17 are, however, pressed toward the closing side by the maximum load pressure $P_{LS}$, acting on the first pressure receiving section 5*a*, and the spring force, while it is pressed toward the opening side by an operating valve outlet pressure (flow pressure after meter in) $P_0$ acting on the second pressure receiving section 5*b*; the pressure receiving areas of the first pressure receiving section 5*a* and the second pressure receiving section 5*b* are the same; hence the operating valve outlet pressure $P_0$ equals the maximum load pressure $P_{LS}$. Thus, if the hydraulic actuators are the right and left travelling hydraulic motors, the opening of the left operating valve 2 is set large for the driving side and the opening of the right operating valve 2 is set small for the driven side for swinging and traveling, and the load pressure $P_{LS1}$ acting on the first pressure receiving section 5*a* of the pressure compensating valve 5 on the braking side is equal to the load pressure $P_{LS2}$ on the driving side, then the flow rate supplied to the right and left traveling hydraulic motors will be the values which are proportional to the opening ratios of both operating valves 2, and the swing radius is controlled by the opening ratios of the two operating valves 2.

However, there is a sixth problem in that the load pressure $P_{LS}$ acting on the first pressure receiving section 5*a* of the pressure compensating valve 5 on the braking side incurs a pressure loss due to leakage or the like, and it becomes lower than the load pressure $P_{LS}$ on the driving side; this causes the inflow into the traveling hydraulic motor on the braking side to increase and the turning radius to be different from the value, which matches the opening ratios of both operating valves 2, making the turning and traveling difficult.

There is also a seventh problem when the hydraulic circuit of FIG. 20 is used for a power shovel, the two left hydraulic actuators 3, 3 act as the traveling motors while the right single hydraulic actuator 3 acts as the boom cylinder, and the two left operating valves 2, 2 are operated to supply the pressurized oil to the traveling motors for traveling. If the right operating valve 2 is operated to supply the pressurized oil to the right boom cylinder to raise the boom, then the rate of flow into the right and left traveling motors suddenly decreases and a traveling deceleration shock occurs, since the rates of flow into the right and left traveling motors 3, 3 and to the boom cylinder 3 are divided in accordance with the opening area ratios of the respective operating valves 2.

If, for instance, a total opening area of the two operating valves 2 for traveling is equal to the opening area of the operating valve 2 for the boom, then the traveling speed will be reduced to half that of independent operation and the boom lifting speed will be also reduced to half that of independent operation.

SUMMARY OF THE INVENTION

The present invention intends to solve the problems described above. The first object of the present invention is to provide a hydraulic circuit for operating a plurality of actuators, whereby the maximum pump delivery pressure stays the same, both at the time of flow merging and at the time of flow branching of the output of a plurality of pumps, in order to solve the first problem previously described.

The second object of the present invention is to provide a hydraulic circuit for operating a plurality of actuators, whereby a pump is set at a minimum swash plate angle to reduce the relief loss when a high load is applied and a relief valve is relieved, and the relief is performed in such a manner that the working responsiveness of the actuators is compensated, to solve the second problem described above.

The third object of the present invention is to provide: a maximum load pressure detector, which features less pressure loss, higher responsiveness, and reduced processing cost; and a maximum load pressure detector, which is designed to prevent oil leakage and to ensure higher responsiveness; to solve the third problem described above.

The fourth object of the present invention is to provide a maximum load pressure detector, which enables the load pressure of a particular actuator supplied to the maximum load pressure detector to be increased or decreased by an external signal, thereby assuring detection of a maximum load pressure with a minimum of pressure fluctuation, to solve the fourth problem discussed above.

The fifth object of the present invention is to provide a maximum load pressure detector, which is mounted on an operating valve, the actuator thereof being not activated by an external force even in the neutral position, to solve the fifth problem discussed above.

The sixth object of the present invention is to provide a pressure compensating valve, which enables operation matching the opening ratio of two operating valves by offsetting a reduction in load pressure with a difference in area of two pressure receiving sections, to solve the sixth problem discussed above.

The seventh object of the present invention is to provide a hydraulic circuit for operating a plurality of actuators, which hydraulic circuit is capable of reducing a shock caused by a decrease in the rate of flow into a particular actuator during simultaneous operation by controlling a decrease of the rate of flow into other actuators, to solve the seventh problem described above.

To accomplish the second object, a first aspect of the present invention provides a hydraulic circuit comprising: a plurality of hydraulic pumps 1; a plurality of operating valves 2 having pressure compensating valves 5, the pressure compensating valves 5 having a plurality of load pressure introduction passages 6 for detecting the load pressures of the plurality of operating valves 2 and feeding them back to the pressure compensating valves; LS valves 10, which control the tilt of swash plates 7 of the hydraulic pumps 1; a relief valve 37, which is provided in the load pressure introduction passages 6 and which has a variable set pressure; main relief valves 32, which are provided in the delivery passages 1*a* of the hydraulic pumps 1 and which have higher set pressures than the relief valve 37 having low set pressure; and a means for making the set pressure of the relief valve 37 variable. Therefore, when the load pressure is high, the swash plates 7 of the hydraulic pumps 1 can be set at the minimum swash plate angle to reduce the relief loss. Setting the pressure of the relief valve 37 at high values causes the main relief valves 32 to carry out the relieving operation, when the load pressure is high, to supply the necessary rate of flow to the actuators without any time delay when the load pressure decreases.

Thus, according to the first aspect of the present invention, with the set pressure of the relief valve 37 set at a low value, the relief loss can be reduced by setting the swash plates 7 of the hydraulic pumps 1 at the minimum swash plate angle when the load pressure is high; and with the set pressure of the relief valve 37 set at a high value, when the load pressure is high, the main relief valves 32 carry out the relieving operation to supply a necessary rate of flow to the actuators without any time delay when the load pressure decreases.

To accomplish the aforesaid first object, a second aspect of the present invention provides a hydraulic circuit comprising: a plurality of hydraulic pumps 1; a plurality of operating valves 2 having pressure compensating valves 5; a plurality of load pressure introduction passages 6 for detecting the load pressures of the plurality of operating valves 2 and feeding them back to the pressure compensating valves 5; a first flow merging and branching valve 26, which merges and branches the flows of the delivery passages 1*a* of the plurality of hydraulic pumps 1; a second flow merging and branching valve 27, which merges and branches the flows of the plurality of load pressure introduction passages 6; a first short-circuit passage 39, which communicates the delivery passages 1*a* of the plurality of hydraulic pumps 1 via check valves 38; a second short-circuit passage 36, which communicates the plurality of load pressure introduction passages 6 via check valves 35; a relief valve 37, which is installed in the second short-circuit passage 36; and an unload valve 40, which is installed in the first short-circuit passage 39 and which is unloaded by the differential pressure between the pump delivery pressure and the load pressure of the second short-circuit passage 36. Therefore, the single relief valve 37 is relieved both at the time of flow merging and at the time of flow branching so that the single unload valve 40 is unloaded to restrict the maximum pump delivery pressure, allowing the maximum pump delivery pressure to be the same at the time of flow merging and at the time of flow branching.

Thus, according to the second aspect of the present invention, both at the time of flow merging and at the time of flow branching, the single relief valve 37 is relieved, thereby unloading the single unload valve 40 to limit the maximum pump delivery pressure. This makes it possible to ensure the same maximum pump delivery pressure at the time of flow merging and at the time of flow branching.

To fulfill the aforesaid third object, a third aspect of the present invention, illustrated in FIG. 3, provides a plurality of pressure detection ports 51 through 53 and a maximum pressure detection port 54, being opened to one end 50*a* of the operating valve main body 50; a pressure introduction port 56; a plurality of charging holes 57, 58; and a pressure take-out port 59 opened to a mounting surface 55*a* in a shuttle valve mounting block 55 attached to the one end 50*a* of the operating valve main body 50. A sealing material 74 is provided at the joint section of the one end 50*a* of the operating valve main body 50 and the mounting surface 55*a* of the shuttle valve mounting block 55 to seal between the ports. The pressure introduction port 56 and the top of the charging hole 57, the vertical midpoints and the tops of the adjoining charging holes 57, 58, the vertical midpoint of the charging hole 58, and the pressure take-out port 59 are communicated via slant communicating holes. Lower seats 68 with inlet ports are fitted to the bottoms of the charging holes 57, 58, and balls 72 are provided on the tops of the lower seats 68 to constitute shuttle valves 73. The pressure detection ports 51 through 53 and the maximum pressure detection port 54 are formed in the operating valve main body 50, and the charging holes 57, 58, and the communicating holes are formed in the shuttle valve mounting block 55. The diameters of the communicating holes can be made large without being restricted by the pressure detection ports 51 through 53, thus ensuring a smaller pressure loss. Since all of the ports are sealed by the joint surface between the one end surface 50*a* of the operating valve main body 50 and the mounting surface 55*a* of the shuttle valve mounting block 55, the output working fluid does not leak toward the low pressure side, leading to higher control accuracy.

Hence, according to the third aspect of the present invention, the pressure detection ports 51, 52, and 53, and the maximum pressure take-out port 54 are formed in the operating valve main body 50; the charging holes 57, 58, and the communicating holes are formed in the shuttle valve mounting block 55, and the diameters of the communicating holes can be made large without being restricted by the pressure detection ports 51, 52, and 53, thus leading to a smaller pressure loss. Since all of the ports are sealed by the joint surface between the one end surface 50*a* of the operating valve main body 50 and the mounting surface 55*a* of the shuttle valve mounting block 55, the output working fluid does not leak toward the low pressure side, leading to higher control accuracy.

The shuttle valve mounting block 55 is discrete from the operating valve 50, and the communicating holes are slanted, permitting easy machining of the communicating holes.

To fulfill the fourth object of the present invention, a fourth aspect of the present invention, illustrated in FIG. 17, provides a hydraulic circuit wherein: the delivery passages 1*a* of the hydraulic pumps 1 are provided with a plurality of operating valves 2; the circuits 4, which connect the operating valves 2 with the hydraulic actuators 3, are provided with the pressure compensating valves 5; the load pressures of the hydraulic actuators 3 are connected to a load pressure detecting passage 161 via check valves 160*a*; and the load pressure detecting passage 161 is connected to the pressure receiving sections 5*a* of the pressure compensating valves 5. The hydraulic circuit is designed so that the opening pressure of the check valves 160*a*, which detect the load pressure of the particular hydraulic actuator 3 at the load pressure detection passage 161, is gradually increased by an external signal (see FIG. 7). Since the valve opening pressures of the check valves 160*a* can be gradually increased by the external signal, it is possible to let the load pressure of the particular hydraulic actuator 3 smoothly flow into the load pressure detection passage 161 with minimized pressure fluctuation or to stop it. When the particular hydraulic actuator 3 is the swinging motor, it is possible to supply a great amount of pressurized oil to another hydraulic actuator 3, e.g., the boom cylinder 3, without detecting the load pressure of the swinging motor in the early stage of swing, and the pressure fluctuation is smoothed when the load pressure of the swinging motor is detected, which leads to smoothed fluctuation in the rate of flow into the hydraulic actuator 3, thereby permitting a reduction in the shock.

Thus, according to the fourth aspect of the present invention, since the valve opening pressures of the check valves 160*a* can be gradually increased by the external signal, the load pressure of the particular actuator 3 can be smoothly flowed into the load pressure detector 161 or smoothly stopped without causing pressure fluctuation.

Hence, when the particular actuator 3 is the swinging motor, it is possible to supply a great amount of pressure oil to the arm cylinder without detecting the load pressure of the swinging motor in the early stage of swing, and the pressure fluctuation is smoothed when the load pressure of the swinging motor is detected, which leads to smoothed fluctuation in the rate of flow into the actuator, thereby permitting a reduction in the shock.

To fulfill the aforementioned fifth object, a fifth aspect of the present invention provides a pressure-compensating hydraulic circuit wherein: the delivery passages 1*a* of the hydraulic pumps 1 are provided with a plurality of operating valves 2; the circuits 4, which connect the operating valves 2 with the hydraulic actuators 3, are provided with the pressure compensating valves 5; the load pressure detection passage 161 for detecting the maximum load pressures of the hydraulic actuators 3 is connected to the pressure receiving sections 5*a* of the pressure compensating valves 5; output ports 132, pump ports 133, actuator ports 134, and tank ports 135 are formed on both right and left sides of a spool hole 131 of the valve main body 130; and the first and second small-diameter sections 140, 141 are formed on both right and left sides of a spool 139, which is fitted in the spool hole 131 to constitute the operating valve 2; the load pressure detection port 136 is formed at a lateral midpoint of the spool hole 131; the load pressure detection ports 140 are formed on the right and left sides of the spool 139; the load pressure detection ports 142 are opened to the first small-diameter sections 140 at the first ports 143, opened to the load pressure detection port 136 at the second ports 144, and opened to the actuator ports 134 at the third ports 146 via the balls 145 so that the right and left second ports 144 open to the load pressure detection port 136 when the spool 139 laterally moves by a fine stroke; and a clearance gap 149, which opens to the actuator port 134, is provided between the spool and the spool hole 131, with the peripheral surface, in which the third ports 146 of the spool 139 are opened, being the small diameter. Therefore, when the operating stroke of the spool 139 is small, the load pressure detected at the load pressure detection port 136 flows out to the actuator ports 134 through the third ports 146 and the clearance gap 149 and further to the tank ports 135 from the actuator port 134. This makes it possible to reduce the shock in the fine operation area of the operating valves 2 and also to reduce the chance of the hydraulic actuators 3 being actuated by an external force, because the pressure oil in the actuator ports 134 merely leaks into the pump ports 133 and the tank ports 135 through the clearance gap between the spool hole 131 and the spool 139 when the spool 139 is in the neutral position.

Thus, according to the fifth aspect of the present invention, when the operating stroke of the spool 139 is small, the load pressure detected at the load pressure detection port 136 flows out to the actuator ports 134 through the third ports 146 and the clearance gap 149 and further to the tank ports 135 from the actuator ports 134. Therefore, the load pressure is decreased, making it possible to reduce the shock in the fine operating area of the operating valves 2. When the spool 139 is in the neutral position, the pressure oil in the actuator ports 134 merely leaks into the pump ports 133 and the tank ports 135 through the clearance gap between the spool hole 131 and the spool 139, making it possible to reduce the chance of the hydraulic actuators 3 being activated by an external force.

To fulfill the sixth object of the present invention, a sixth aspect of the present invention provides a pressure-compensating hydraulic circuit wherein: the delivery passages 1*a* of the hydraulic pumps 1 are provided with a plurality of operating valves 2; the circuits 4, which connect the operating valves 2 with the hydraulic actuators 3, are provided with the pressure compensating valves 5; the load pressure detection passage 161, for detecting the maximum load pressures of the hydraulic actuators 3, is provided with the load pressure detection passage 161 being connected to the pressure receiving sections 5*a* of the pressure compensating valves 5; the pressure compensating valves 5 are shaped so that they are pressed onto the closing side by the load pressure acting on the first pressure receiving section 5*a* and pressed onto the opening side by the inlet side pressure acting on the second pressure receiving section 5*b*; and a pressure receiving area $A_1$ of the first pressure receiving section 5*a* is made larger than a pressure receiving area $A_0$ of the second pressure receiving section 5*b*. Therefore, when the two operating valves are actuated to supply the pressure oil to the right and left traveling motors for swinging and traveling, a decrease in the load pressure $P_{LS}$ can be offset by the difference in the pressure receiving area between the first and second pressure receiving sections 5*a*, 5*b* of the pressure compensating valves 5, thus permitting smooth swing and travel with a swing radius which matches the opening ratio of the two operating valves.

Thus, according to the sixth aspect of the present invention, when the two operating valves are actuated to supply the pressurized oil to the right and left traveling motors for swinging and traveling, a decrease in the load pressure $P_{LS}$ can be offset by the difference between the pressure receiving areas of the first and second pressure receiving sections 5*a*, 5*b* of the pressure compensating valves 5, thereby permitting smooth swing and travel with a swing radius which matches the opening ratio of the two operating valves.

To fulfill the seventh object, a seventh aspect of the present invention, illustrated in FIG. 11, provides a pressure-compensating hydraulic circuit wherein: the delivery passages 1*a* of the hydraulic pumps 1 are provided with a plurality of operating valves 2; the circuits 4, which connect the operating valves 2 with the hydraulic actuators 3, are provided with the pressure compensating valves 5; the load pressure detection passage 161 for detecting the maximum load pressures of the hydraulic actuators 3 is connected to the pressure receiving sections 5*a* of the pressure compensating valves 5; and a means, which, when the pressure oil is supplied to a particular hydraulic actuator 3, decreases the load pressure acting on the pressure receiving section 5*a* of the pressure compensating valve 5 provided in the circuit 4 of another particular hydraulic actuator 3. Therefore, when the pressure oil is supplied to a particular hydraulic actuator 3, the pressure acting on the pressure receiving section 5*a* of the pressure compensating valve 5 on another particular hydraulic actuator 3 side drops, and the rate of flow passing through that pressure compensating valve 5 grows larger than the rate of flow passing through the pressure compensating valve 5 on the particular hydraulic actuator 3 side. Hence, if the particular hydraulic actuator 3 is the boom cylinder and the other particular hydraulic actuator 3 is the traveling motor, then the rate of flow into the boom cylinder decreases and the rate of flow into the traveling motor does not decrease much when the boom rises while traveling, enabling a reduced shock from travel deceleration.

Thus, according to the seventh aspect of the present invention, when the pressurized oil is supplied to a particular hydraulic actuator 3, the load pressure acting on the pressure receiving section 5*a* of the pressure compensating valve 5 on another particular hydraulic actuator 3 side drops and the rate of flow grows larger than the rate of flow passing through the pressure compensating valve 5. Hence, if the particular hydraulic actuator 3 is the boom cylinder and the other particular hydraulic actuator 3 is the traveling motor, then the rate of flow into the boom cylinder decreases and the rate of flow into the traveling motor does not decrease much when the boom rises while traveling, enabling a reduced shock from travel deceleration.

BEST MODE FOR CARRYING OUT THE INVENTION

Figure 1:
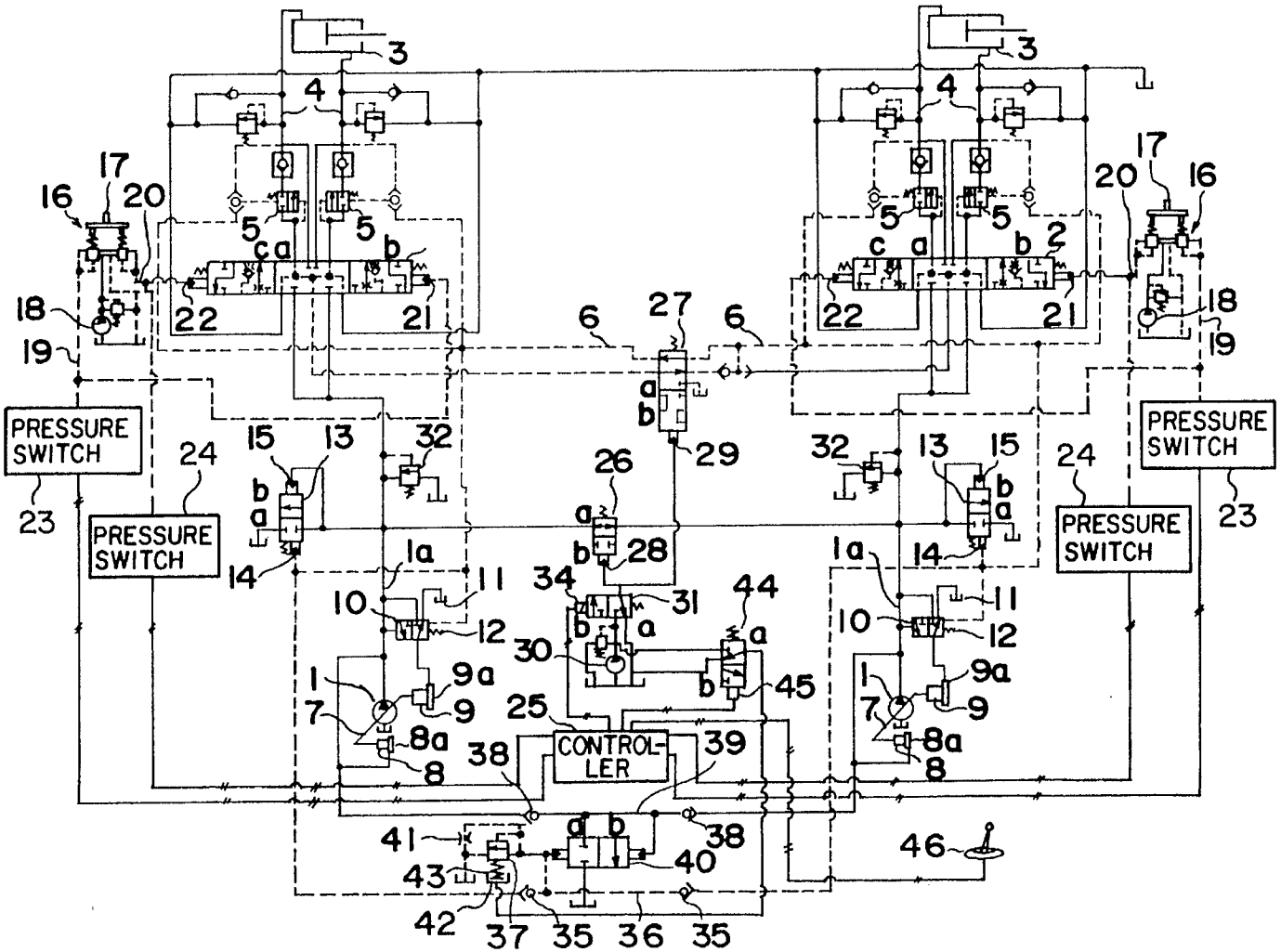
FIG. 1 is a diagram showing a configuration which includes a first embodiment of the present invention corresponding to the first aspect of the present invention and a second embodiment of the present invention corresponding to the second aspect of the invention.

The embodiments of the present invention will now be described. Components which are the same as those of the background art described above are given the same reference numerals, and the explanation thereof will be omitted.

In FIG. 1, which shows the first embodiment of the present invention, the delivery passage 1*a* of the hydraulic pump 1 is provided with the operating valve 2; and the circuit 4, which connects the operating valve 2 with the actuator 3, is provided with the pressure compensating valve 5. The load pressure of the actuator 3 is introduced into the load pressure introduction passage 6 via the restrictor in the operating valve 2.

A swash plate 7 of the hydraulic pump 1 is tilted toward a larger capacity by a small-diameter piston 8, while the swash plate 7 is tilted toward a smaller capacity by a large-diameter piston 9. A small-diameter pressure receiving chamber 8*a* of the small-diameter piston 8 is connected to the delivery passage 1*a* to supply the pump delivery pressure. A large-diameter pressure receiving chamber 9*a* of the large-diameter piston 9 is selectively connected by an LS valve 10 to either the delivery passage 1*a* or a tank 11 so that chamber 9*a* is controlled by the delivery passage 1*a* or the tank 11.

The LS valve 10 is pressed to a drain position a by the load pressure and a spring 12, while it is pressed to a supply position b by the pump delivery pressure. The LS valve 10 tilts the swash plate 7 to set the pump delivery pressure to a slightly higher level than the load pressure, e.g., 20 $kg/cm^2$.

The delivery passage 1*a* of the hydraulic pump 1 is provided with an unload valve 13. The unload valve 13 is pressed to its onload position a by a spring and the load pressure supplied to the first pressure receiving section 14, while it is pressed to its unload position b by the pump delivery pressure supplied to the second pressure receiving section 15. When the differential pressure between the pump delivery pressure and the load pressure exceeds a set pressure, e.g., 30 $kg/cm^2$ the unload valve 13 is set in its unload position b and is operated only by the individual pump delivery pressures of the plurality of the hydraulic pumps 1 and the load pressure.

A pilot hydraulic valve 16 is actuated by operating lever 17 to supply the delivery pressure oil of an auxiliary pump 18 to the first and second pressure receiving sections 21, 22 of an operating valve 2 via the first and second pilot lines 19, 20, to thereby switch the operating valve 2 from its neutral position a to its first position b or its second position c. The first and second pilot lines 19, 20 are provided with the first and second pressure switches 23, 24 so that they issue electrical signals to a controller 25 when a pressure occurs.

Exactly the same explanation given above applies to both left and right hydraulic pumps 1, 1.

The delivery passage 1*a* of the left hydraulic pump 1 and the delivery passage 1*a* of the right hydraulic pump 1 are allowed to merge or branch at the first merging and branching valve 26. The left load pressure introduction passage 6 and the right load pressure introduction passage 6 are allowed to merge or branch at the second merging and branching valve 27. The first and second merging and branching valves 26, 27 are pressed to flow merging positions a, a by a spring force and are switched to flow branching positions b, b by the pilot pressure oil.

The delivery pressure oil of the auxiliary pump 30 is supplied through a solenoid valve 31 to the pressure receiving sections 28, 29. The solenoid valve 31 is held in its drain position a by a spring force and is switched to its supply position b when a solenoid 34 is energized, the solenoid 34 being controlled by the controller 25.

The left load pressure introduction passage 6 and the right load pressure introduction passage 6 are communicated through a short-circuit passage 36 which has a pair of check valves 35, 35. The short-circuit passage 36 is provided with a relief valve 37. The delivery passage 1*a* of the left hydraulic pump 1 and the delivery passage 1*a* of the right hydraulic pump 1 are communicated through a short-circuit passage 39 which has a pair of check valves 38, 38. An unload valve 40 is connected to the short-circuit passage 39.

The unload valve 40 is held in its onload position a by the spring force and the load pressure of the short-circuit passage 36, and it is switched to its unload position b by the pump delivery pressure of the short-circuit passage 39, the unload valve 40 being set at a pressure which is lower than the set pressure of the individual unload valves 13, 13. In other words, the differential pressure between the pump delivery pressure and the load pressure at the time of unloading is set low.

The relief valve 37 is provided with a cylinder 42 with a variable set pressure. The delivery oil pressure of the auxiliary hydraulic pump 30 is supplied to a pressure receiving chamber 43 of relief valve 37 by a solenoid valve 44. The solenoid valve 44 is held in its drain position a by the spring force and it is switched to its supply position b when the solenoid 45 is energized, the solenoid 45 being energized when a signal is supplied to the controller 25 by using a selector switch 46.

The operations will now be explained.

(1) Operation wherein the first and second merging and branching valves 26, 27 are set in the flow branching positions b, b, and the pressurized oil is supplied to the left actuator 3 without the selector switch 46 sending a signal to the controller 25:

When the pilot hydraulic valve 16 is operated by a left operating lever 17 to supply the pilot pressure oil to the first pilot line 19, the pilot pressure oil is supplied to the first pressure receiving section 21 of the operating valve 2 and the operating valve 2 is set in the first position b, causing the delivery pressure oil of the left hydraulic pump 1 to be supplied to the left actuator 3. The load pressure of the left actuator 3 is introduced to the load pressure introduction passage 6 via a restrictor installed in the first position b of the operating valve 2.

This causes the first pressure switch 23 to apply an electrical signal to the controller 25, and the controller 25 determines that the left operating valve 2 has been set in its first position b, whereby the controller 25 performs an operation based on a preset pattern to decide whether or not to carry out flow merging. If the controller 25 decides to carry out the flow merging, then it does not operate the solenoid 34 of the solenoid valve 31, so that the solenoid valve 31 stays in its drain position a; and with the first and second merging and branching valves 26, 27 set in the flow merging positions a, a, it merges the delivery pressure oils of the left and right hydraulic pumps 1 to supply them to the left actuator 3. To carry out flow branching, the solenoid 34 of the solenoid valve 31 is energized to set solenoid valve 31 in its supply position b, and the delivery pressure oil of the auxiliary hydraulic pump 30 is supplied to the pressure receiving sections 28, 29 of the first and second flow merging and branching valves 26, 27 to set for the branching positions b. b. thus supplying only the delivery pressure oil of the left hydraulic pump 1 to the left actuator 3.

The load pressure, which has flowed into the load pressure introduction passage 6, flows into the short-circuit passage 36 through one check valve 35 to act on the inlet side of the relief valve 37.

At this time, the pressurized oil is not supplied to the pressure receiving chamber 43 of the cylinder 42 having variable set pressure for the relief valve 37, resulting in a low set pressure.

Thus, when the load pressure of the actuator 3 becomes higher than the low set pressure of the relief valve 37, the relieving operation is carried out to cause the load pressure to drop and the unload valve 40 to unload. This, in turn, causes a part of the pump delivery pressure to flow into the reservoir tank, thereby limiting the pump delivery pressure. The then differential pressure between the pump delivery pressure and the load pressure is larger than the differential pressure set by the LS valve 10.

At the same time, the LS valve 10 is set in its supply position b, and the pump delivery pressure is supplied to the large -diameter pressure receiving chamber **9*a*, setting the swash plate 7** in the minimum swash plate position.

(2) Operation wherein a signal is supplied to the controller 25 by the selector switch 46 and the first and second merging and branching valves 26, 27 are set in the branching positions b, b to supply the pressurized oil to the left actuator 3:

This operation is the same as that of (1) above, except that the controller 25 energizes the solenoid 45 of the solenoid valve 44 to set the solenoid valve 44 in its supply position b; the delivery pressure oil is supplied to the pressure receiving chamber 43 of the cylinder 42 having variable set pressure, causing the set pressure of the relief valve 37 to increase to an extremely high value.

Hence, even when the load pressure becomes high, as in the case of (1) above, the relief valve 37 is not relieved, and the pump delivery pressure increases as the load pressure increases.

When the pump delivery pressure exceeds the set pressure of the main relief valve 32, the main relief valve 32 carries out the relieving operation to limit the pump delivery pressure. The then differential pressure between the pump delivery pressure and the load pressure is the differential pressure set by the LS valve 10, and the swash plate 7 is not set in the minimum swash plate position.

When the load of the actuator 3 decreases under this condition and the load pressure decreases, the pump delivery pressure also decreases and the main relief valve 32 closes. However, the responding speed of the main relief valve 32 is much slower than the responding speed of the swash plate 7. Therefore, when the load pressure drops a little from the relieved state described above, all of the relieved oil will immediately flow into the actuator 3. Hence, there will be no time delay, and the operator does not get a feeling that the excavating power is lower than it really is.

(3) Operation of flow merging and branching

According to the operation described in (1) above, the first pressure switch 23 applies an electrical signal to the controller 25, and the controller 25 determines that the left operating valve 2 is set in its first position b, whereby the controller 25 performs an operation based on a preset pattern to decide whether or not to carry out flow merging. If the controller 25 decides to carry out the flow merging, then it does not energize the solenoid 34, so that the solenoid valve 31 stays in its drain position a; and with the first and second merging and branching valves 26, 27 set in the flow merging positions a, a, it merges the delivery pressure oils of the left and right hydraulic pumps 1 to supply them to the left actuator 3.

To carry out flow branching, the solenoid 34 of the solenoid valve 31 is energized to set it in its supply position b, and the delivery pressure oil of the auxiliary hydraulic pump 30 is supplied to the pressure receiving sections 28, 29 of the first and second flow merging and branching valves 26, 27 to set the branching positions b, b, thus supplying only the delivery pressure oil of the left hydraulic pump 1 to the left actuator 3.

On the other hand, the load pressure of the load pressure introduction passage 6 acts on the LS valve 10 to tilt the swash plate 7 of the hydraulic pump 1 and to set the differential pressure between the pump and the load pressure at the set pressure. The load pressure also acts on the pressure compensating valve 5 to perform pressure compensation.

The above also applies to a case wherein the left lever 17 is moved in the opposite direction to supply the pilot pressure oil to the second pilot line 20, and to a case wherein the right lever 17 is operated.

The unloading operation (the operation of limiting the maximum pump delivery pressure of the hydraulic pump) of the unload valve 40 at the time of flow merging will now be described.

When the left actuator 3 reaches a stroke end under the condition described above or when the load of the left actuator 3 is extremely high and the load pressure is extremely high, the load pressure flows into the short-circuit passage 36 via a check valve 35 and it is relieved through the relief valve 37.

The pump delivery pressure oils of the left and right hydraulic pumps 1, 1 flow into the short-circuit passage 39 via the check valves 38, and as soon as pump delivery pressure oil reaches the inlet side of the unload valve 40, it acts on the pressure receiving section of the unload valve 40.

This causes the load pressure acting on the unload valve 40 to drop lower than the pump delivery pressure and the unload valve 40 to be set in its unload position b, thus unloading a part of the delivery pressure oils of the left and right hydraulic pumps 1, 1.

The unloading operation (the operation of limiting the maximum pump delivery pressure of the hydraulic pump) of the unload valve 40 at the time of flow branching will now be described.

The moment the delivery passage 1*a* of the left hydraulic pump 1 and the delivery passage 1*a* of the right hydraulic pump 1 are separated, the left load pressure introduction passage 6 and the right load pressure introduction passage 6 are separated. Therefore, when the load pressure of the left actuator 3 becomes extremely high, the load pressure flows into the short-circuit passage 36 through the left check valve 35 and is prevented from flowing into the right load pressure passage 6 through the right check valve 35. The load pressure is relieved through the relief valve 37 in the same manner as that described above.

The delivery pressure oil of the left hydraulic pump 1 flows into the short-circuit passage 39 through the left check valve 38 and is prevented from flowing into the delivery passage 1*a* of the right hydraulic pump 1 through the right check valve 38, the pump delivery pressure oil acting on the inlet side of the unload valve 40.

Thus, in the same manner as in the case of flow merging, the unload valve 40 is set in its unload position b to unload a part of the pump delivery pressure.

In the operation discussed above, if the right operating valve 2 is in its neutral position a, then the right load pressure introduction passage 6 is connected to the tank via the neutral position a of the operating valve 2. Therefore, the load pressure is nearly 0 kg/cm$^2$, and the load pressure acting on the first pressure receiving section 14 of the right unload valve 13 becomes nearly 0 kg/cm$^2$. The unload valve 13 is set in its unload position b by the low pump delivery pressure acting on the second pressure receiving section 15, resulting in an extremely low pressure of the pump delivery pressure of the right hydraulic pump 1 .

Figure 2:
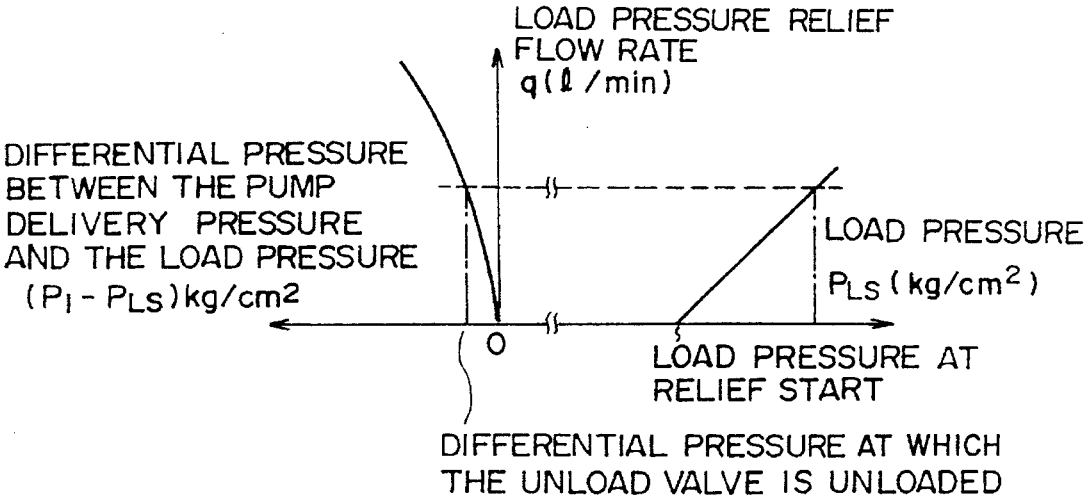
FIG. 2 is a chart showing a relationship between the relief flow rate and the load pressure in the second embodiment shown in FIG. 1.

Thus, both at the time of flow merging and at the time of flow branching, the load pressure is relieved through the single relief valve 37. Therefore, the relief rate of flow, which provides the differential pressure at which the unload valve 40 is unloaded, is determined by the override characteristic of the relief valve 37. The then load pressure becomes the same as shown in FIG. 2, and the maximum pump delivery pressure can be made the same both at the time of merging and at the time of branching.

Further, in FIG. 1, the inflow side of the relief valve 37 and the tank are communicated through a small-diameter orifice 41 in order to quickly let the load pressure of the short-circuit passage 36, which is shut off by a pair of check valves 35, 35, flow into the tank when the operating valve 2 is set in its neutral position a.

The embodiment described above uses flow merging and branching valves, but it is not limited to the same.

For the second embodiment of the present invention, in FIG. 1, the cylinder 42 with variable set pressure, the pressure receiving chamber 43, the solenoid valve 44, the solenoid 45, and the selector switch 46 will be omitted, because the set pressure of the relief valve 37 will be fixed. In addition, the configuration and action will be the same as those of the first embodiment except that the main relief valve 32 will be omitted. Therefore, only the action peculiar to the second embodiment will be explained.

The unloading operation (the operation of limiting the maximum pump delivery pressure of the hydraulic pump) of the unload valve 40 at the time of flow merging will now be described.

When the left actuator 3 reaches a stroke end or when the load of the left actuator 3 is extremely high and the load pressure is extremely high, the load pressure flows into the short-circuit passage 36 via the left check valve 35 and is relieved through the relief valve 37. The pump delivery pressure oils of the left and right hydraulic pumps 1, 1 flow into the short-circuit passage 39 via the check valves 38, and as soon as pump delivery pressure oil reaches the inlet side of the unload valve 40, it acts on the unload valve 40.

This causes the load pressure acting on the unload valve 40 to drop lower than the pump delivery pressure and the unload valve 40 to be set in its unload position b, thus unloading a part of the delivery pressure oils of the left and right hydraulic pumps 1, 1.

The unloading operation (the operation of limiting the maximum pump delivery pressure of the hydraulic pump) of the unload valve 40 at the time of flow branching will now be described.

The moment the delivery passage 1*a* of the left hydraulic pump 1 and the delivery passage 1*a* of the right hydraulic pump 1 are separated, the left load pressure introduction passage 6 and the right load pressure introduction passage 6 are separated. Therefore, when the load pressure of the left actuator 3 becomes extremely high, the load pressure flows into the short-circuit passage 36 through the left check valve 35 and is prevented from flowing into the right load pressure passage 6 through the right check valve 35. The load pressure is relieved through the relief valve 37 in the same manner as that described above.

The delivery pressure oil of the left hydraulic pump 1 flows into the short-circuit passage 39 through the left check valve 38 and is prevented from flowing into the delivery passage 1*a* of the right hydraulic pump 1 through the right check valve 38, the pump delivery pressure acting on the inlet side of the unload valve 40.

Thus, in the same manner as in the case of flow merging, the unload valve 40 is set in its unload position b to unload a part of the pump delivery pressure oil.

In the operation discussed above, if the right operating valve 2 is in the neutral position a, then the right load pressure introduction passage 6 is connected to the tank via the neutral position a of the operating valve 2. Therefore, the load pressure is nearly 0 kg/cm$^2$ and the load pressure acting on the first pressure receiving section 14 of the right unload valve 13 becomes nearly 0 kg/cm$^2$. The unload valve 13 is set in its unload position b by the low pump delivery pressure acting on the second pressure 10 receiving section 15, resulting in an extremely low pressure of the pump delivery pressure of the right hydraulic pump 1.

Thus, both at the time of flow merging and at the time of flow branching, the load pressure is relieved through the single relief valve 37. Therefore, the relief rate of flow, which provides the differential pressure at which the unload valve 40 is unloaded, is determined by the override characteristic of the relief valve 37. The then load pressure becomes the same as shown in FIG. 2, and the maximum pump delivery pressure can be made the same both at the time of merging and at the time of branching.

Figure 3:
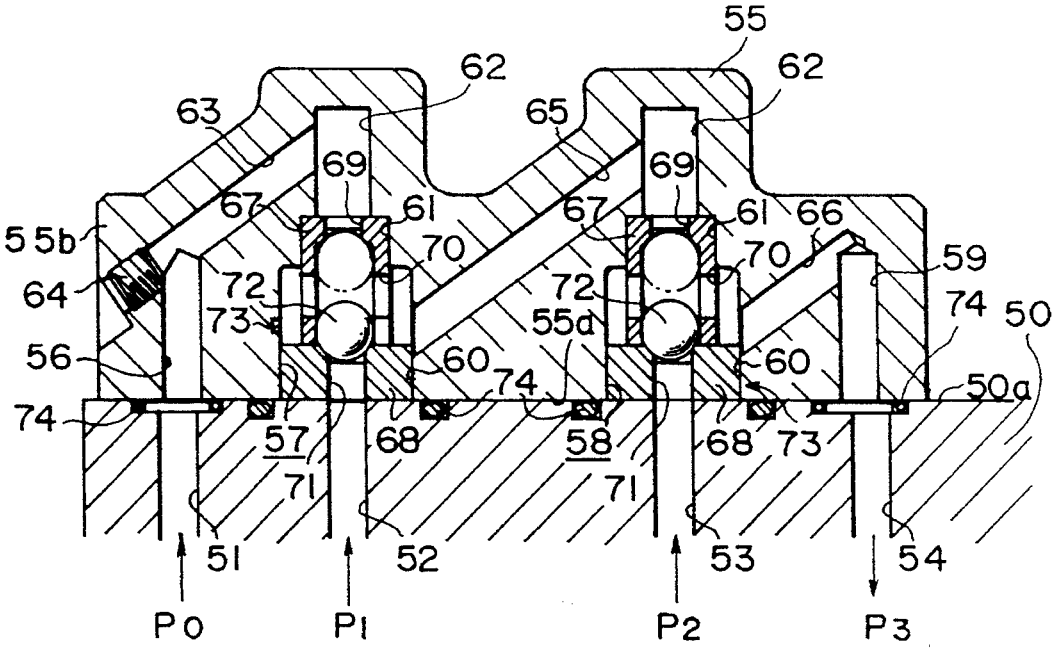
FIG. 3 is a diagram showing a third embodiment of the present invention which corresponds to the third aspect of the present invention.

In FIG. 3, showing the third embodiment of the present invention, the first, second, and third detection ports 51, 52, and 53 and the maximum pressure detection port 54 are formed in an operating valve main body 50, with each port being opened to the one end surface 50*a* of the operating valve main body 50, and the shuttle valve mounting block 55 being mounted attached to the one end surface 50*a*.

The pressure introduction port 56, the first and second inserting holes 57, 58, and the pressure take-out port 59 are formed in the shuttle valve mounting block 55 and are opened to the mounting surface 55*a*, facing the ports described above. The first and second inserting holes 57, 58 are staged holes, wherein they are large -diameter holes 60 at the bottom, medium-diameter holes 61 at the middle, and small-diameter holes 62 at the top. The pressure introduction port 56 is communicated with the small-diameter hole 62 at the top of the first inserting hole 57 through a first communicating hole 63. The first communicating hole 63 is slanted, opened to an end outer surface 55*b* of the shuttle valve mounting block 55, and blocked up with a blind cap 64.

The lower large -diameter hole 60 of the first inserting hole 57 and the upper small-diameter hole 62 of the second inserting hole 58 are communicated through a second communicating hole 65. The second communicating hole 65 is slanted, and it can be drilled by putting a drill through the lower large -diameter hole 60 of the first inserting hole 57. The lower large -diameter hole 60 of the second inserting hole 58 and the pressure take-out hole 59 are communicated through a third communicating hole 66. The third communicating hole 66 is slanted, and it can be drilled by putting the drill through the lower large-diameter hole 60 of the second inserting hole 58.

Upper seats 67 are press-fitted in the medium-diameter holes 61 at the middle of the first and second inserting holes 57, 58, and lower seats 68 are press-fitted in the lower large -diameter holes 60. A first inlet port 69, opened to the upper small-diameter hole 62, and an outlet port 70 are formed in the upper seats 67, with the first inlet port 69 opened to the lower large -diameter hole 60. Second inlet ports 71, which open the pressure detection ports to the outlet ports 70, are formed in the lower seats 68. Balls 72 are provided between the upper seats 67 and the lower seats 68. The thus constituted shuttle valves 73 communicate the ends of the first and second inlet ports 69, 71 on one side with the outlet ports 70.

Sealing materials 74 are provide around the open ends of the first, second, and third pressure detection ports 51, 52, 53 and the maximum pressure detection port 54, and they are press-attached and sealed to the mounting surface 55*a* of the shuttle valve mounting block 55.

The operation will now be explained.

The working fluid of the first pressure detection port 51 and the working fluid of the second pressure detection port 52 flow into the first and second inlet ports 69, 71 of the left shuttle valve 73 and are compared. The working fluid with the higher pressure is outputted to the outlet port 70. The outputted working fluid and the working fluid of the third pressure detection port 53 flow into the first and second inlet ports 69, 71 of the right shuttle valve 73 and are compared. The working fluid with the higher pressure is outputted from the pressure take-out port 59 to the maximum pressure detection port 54. Therefore, when the pressures of the working fluids of the first, second, and third pressure detection ports 51, 52, 53 are $P_0$, $P_1$, $P_2$, with $P_0<P_1<P_2$, then the working fluid of the third pressure detection port 53 will be outputted to the maximum pressure detection port 54.

Figure 4:
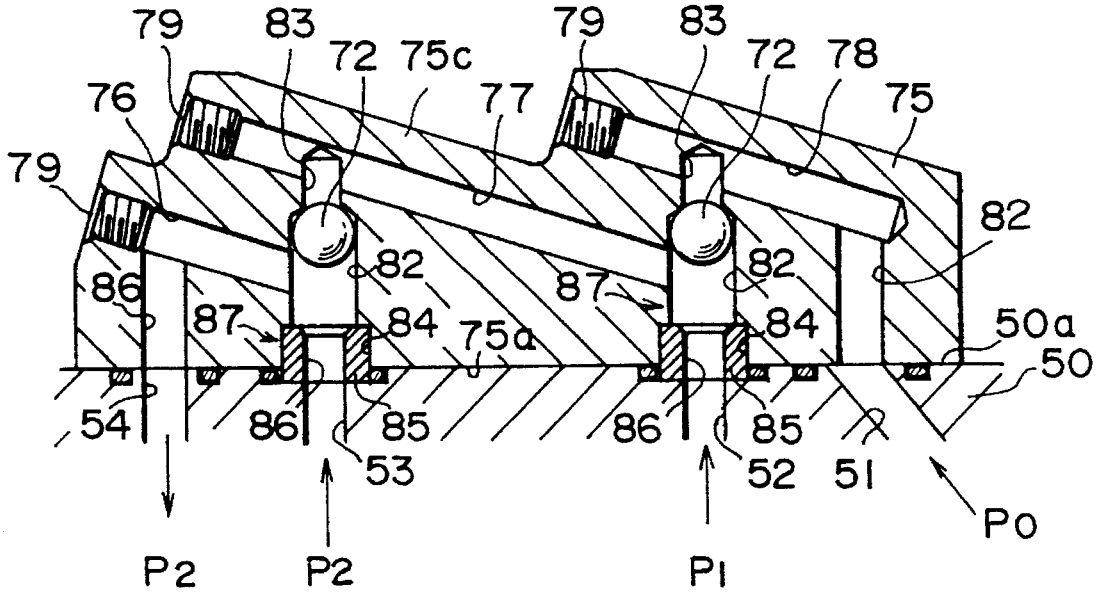
FIG. 4 is a diagram showing a fourth embodiment of the present invention which corresponds to the third aspect of the invention.

In FIG. 4, showing the fourth embodiment of the present invention as another version of FIG. 3, a top surface 75*c* of the shuttle valve mounting block 75 is corrugated. The first, second, and third communication holes 76, 77, 78 are drilled aslant from the top surface 75*c* of the shuttle valve mounting block 75 and are blocked up with blank caps 79. Balls 72 are loosely fitted in medium-diameter holes 82, 82 at the middle of the first and second inserting holes 80, 81 and are pressed against the peripheries of the upper small-diameter holes 83, with the upper seats 67 in FIG. 3 being omitted. Lower seats 85 are force-fitted in the lower large-diameter holes 84. Inlet ports 86 are formed in the lower seats 85 and communicate with the pressure detection ports 52, 53° The balls 72 are disposed between the upper small-diameter holes 83 and the lower seats 85, thus constituting a shuttle valve 87 which communicates the pressures of the upper small-diameter holes 83 and the pressure of the pressure detection port 52 or 53, whichever is higher, with the first and second communicating holes 76, 77.

Hence, when the pressures of the working fluids of the first, second, and third pressure detection ports 51, 52, 53 are $P_0$, $P_1$, $P_2$, with $P_0<P_1<P_2$, then the working fluid of the third pressure detection port 53 will be outputted to the maximum pressure detection port 54.

Figure 5:
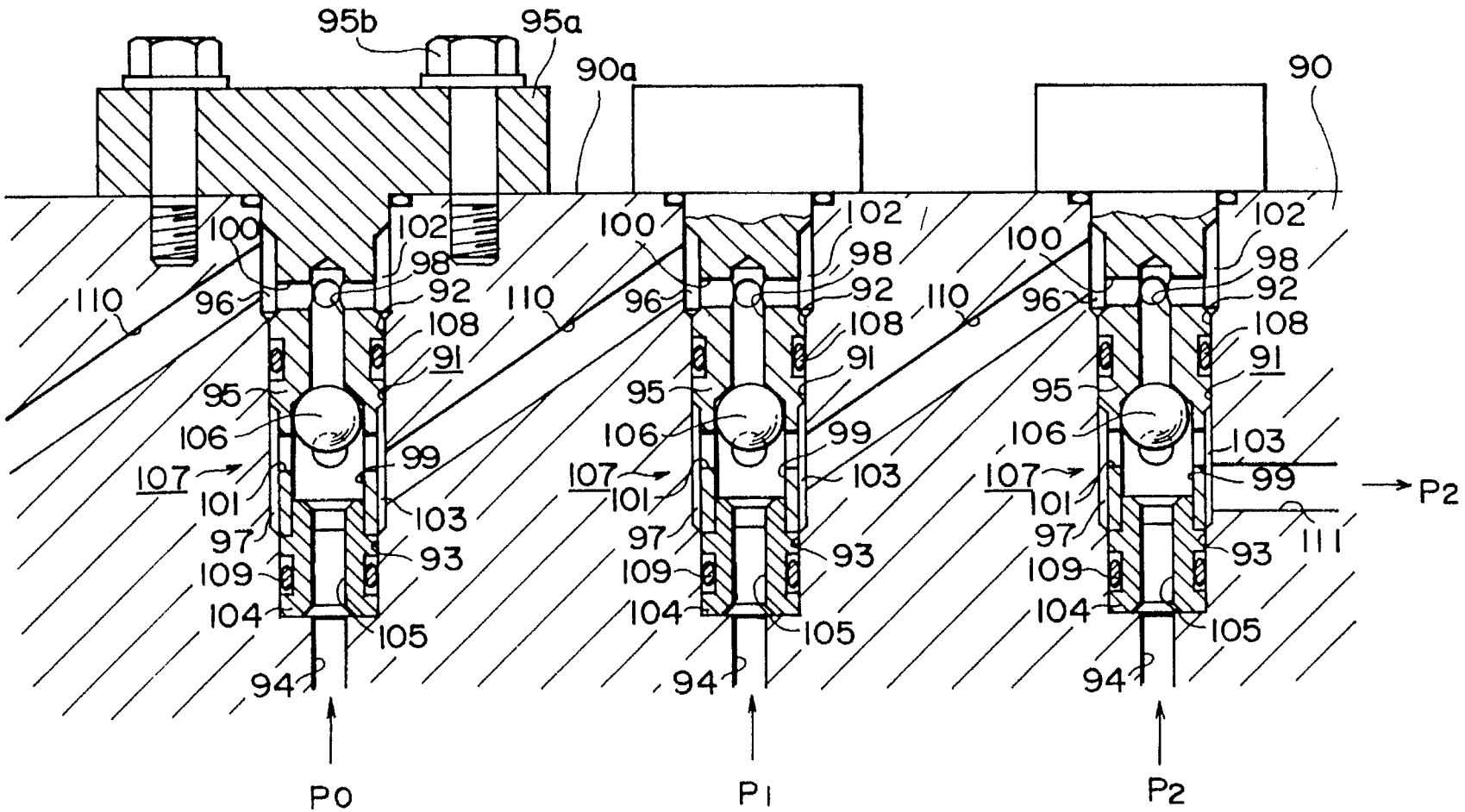
FIG. 5 is a diagram showing a fifth embodiment of the present invention which corresponds to the third aspect of the invention.

In FIG. 5, which shows the seventh embodiment of the present invention, a valve main body 90, such as an operating valve main body, is provided with a plurality of inserting holes 91 which are open to one end surface 90*a* and which are drilled parallel to each other. The inserting holes 91 are staged with upper large-diameter holes 92 and lower small-diameter holes 93, the bottoms thereof having pressure detection ports 94.

Shuttle valve main bodies 95 are fitted into the upper large-diameter holes 92 of the inserting holes 91, with a flange 95*a* being fixed to the end surface 90*a* of the valve main body 90 by bolts 95*b*. The shuttle valve main bodies 95 have upper small-diameter sections 96 and lower small-diameter sections 97. The shaft cores have staged holes in the form of upper small-diameter holes 98 and lower large-diameter holes 99, which open to the bottom end surface. The upper small-diameter holes 98 open to the upper small-diameter sections 96 at vertical upper ports 100, and also open to the lower large -diameter holes 99 at middle outlet ports 101. Annular upper spaces 102 are provided between the inserting holes 91 and the upper small-diameter sections 96 of the shuttle valve main bodies 95. The upper ports 100 and the upper small-diameter holes 98 constitute upper inlet ports. Annular lower spaces 103 are provided between the lower small-diameter sections 97 and the inserting holes 91. Sleeves 104 are fitted to the lower large -diameter holes 99 of the shuttle valve main bodies 95, the sleeves 104 being fitted to the lower small-diameter holes 93 of the inserting holes 91. The sleeves 104 have lower inlet ports 105, which open to the pressure detection ports 94. Balls 106 are incorporated in the lower large -diameter holes 99 of the shuttle valve main bodies 95. The thus constituted shuttle valves 107 communicate either the upper small-diameter holes 98 (upper inlet ports) or lower inlet ports 105 with the middle outlet ports 101.

The shuttle valve main bodies 95 are sealed against the upper large-diameter holes 92 of the inserting holes 91 by sealing materials 108. The sleeves 104 are sealed against the lower large-diameter holes 93 of the inserting holes by sealing materials 109.

The upper spaces 102 and the lower spaces 103 of the adjoining shuttle valves 107, 107 are communicated through communicating holes 110, which are vertically aslant with respect to the horizon. The communicating holes 110 can be drilled by putting a drill aslant through the upper large-diameter holes 92 of the inserting holes 91. The lower space 103 of the endmost shuttle valve 107 opens to and communicates with a pressure detection port 111.

The operation will now be described.

The shuttle valve 107 compares the pressure of the working fluid flowing into the upper small-diameter hole 98 (upper inlet port) with that of the working fluid flowing into the lower inlet port 105 and outputs the working fluid with the higher pressure to the lower space 103 through the middle outlet port 101. The higher pressure working fluid, which has been outputted to the lower space 103, flows into the upper space 102 of the adjoining shuttle 107 through the communicating hole 110, and is compared with the working fluid which has flowed in through the pressure detection port.

For example, when the pressure of the working fluid of the left pressure detection port 94 is $P_0$, the pressure of the working fluid of the middle pressure detection port 94 is $P_1$, and the pressure of the working fluid of the right pressure detection port 94 is $P_2$, with $P_0<P_1<P_2$, then the working fluid of the pressure $P_2$ will be outputted to the pressure detection port 111.

Figure 6:
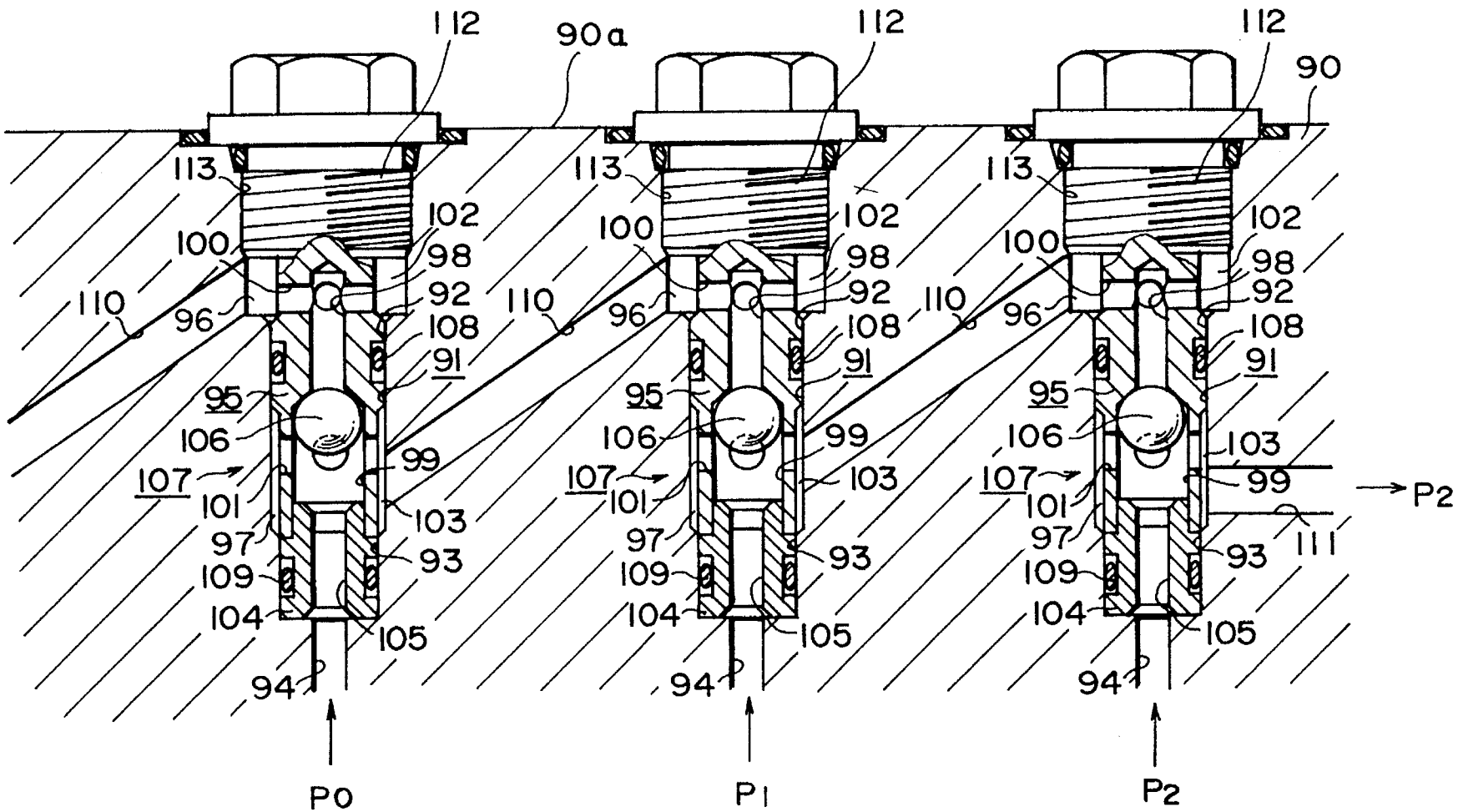
FIG. 6 is a diagram showing a sixth embodiment of the present invention which corresponds to the third aspect of the invention.

In FIG. 6, which shows the eighth embodiment of the present invention as another version of FIG. 5, threaded sections 112 can be formed on the tops of the shuttle valve main bodies 95 and screwed to threaded sections 113 of an upper portion of inserting holes 91, to fix the shuttle valve main bodies 95 to the valve main bodies 90. The rest of the configuration is the same as that shown in FIG. 5, and the explanation thereof will be omitted.

Figure 7:
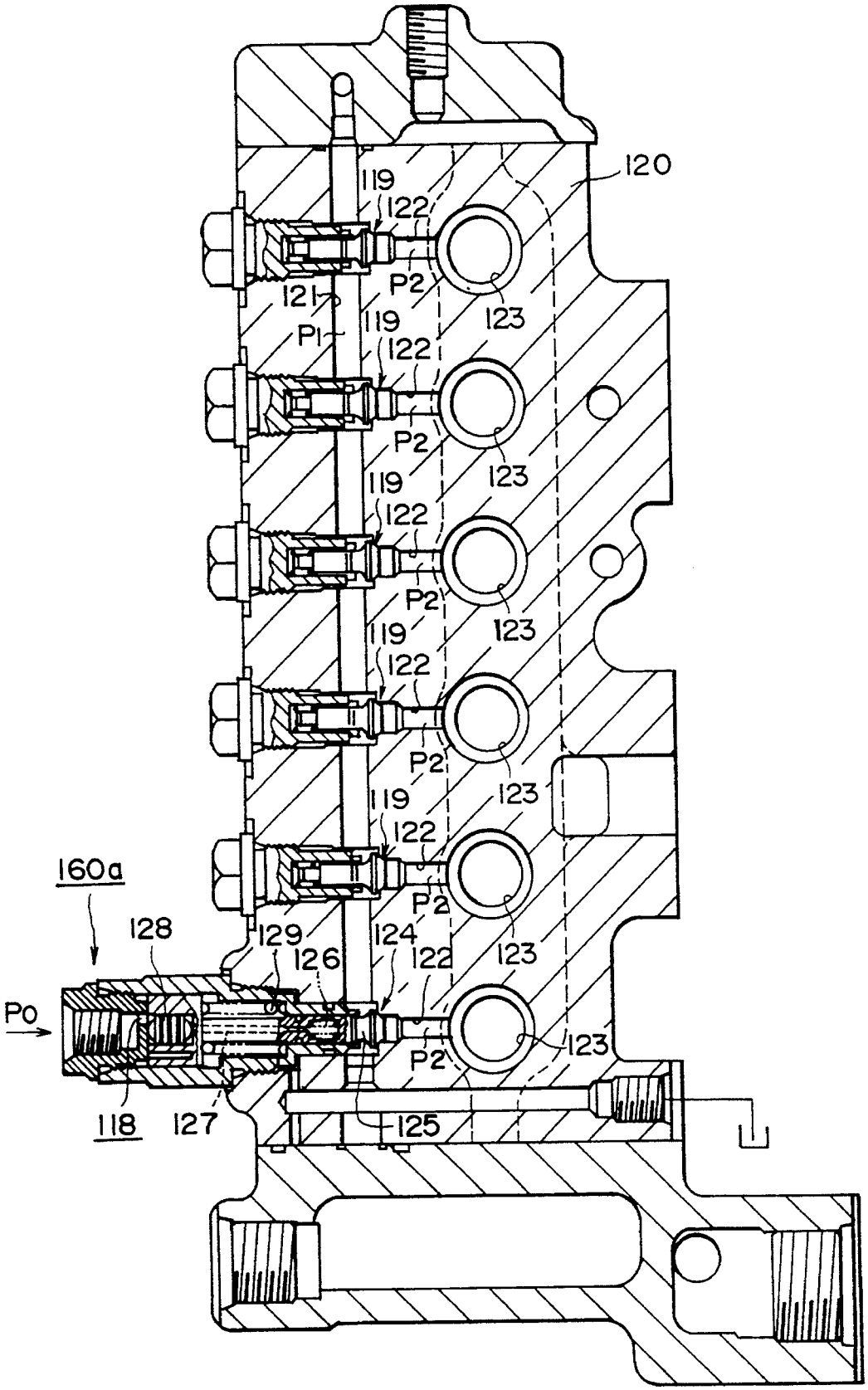
FIG. 7 is a diagram showing a seventh embodiment of the present invention which corresponds to the fourth aspect of the invention.
Figure 17:
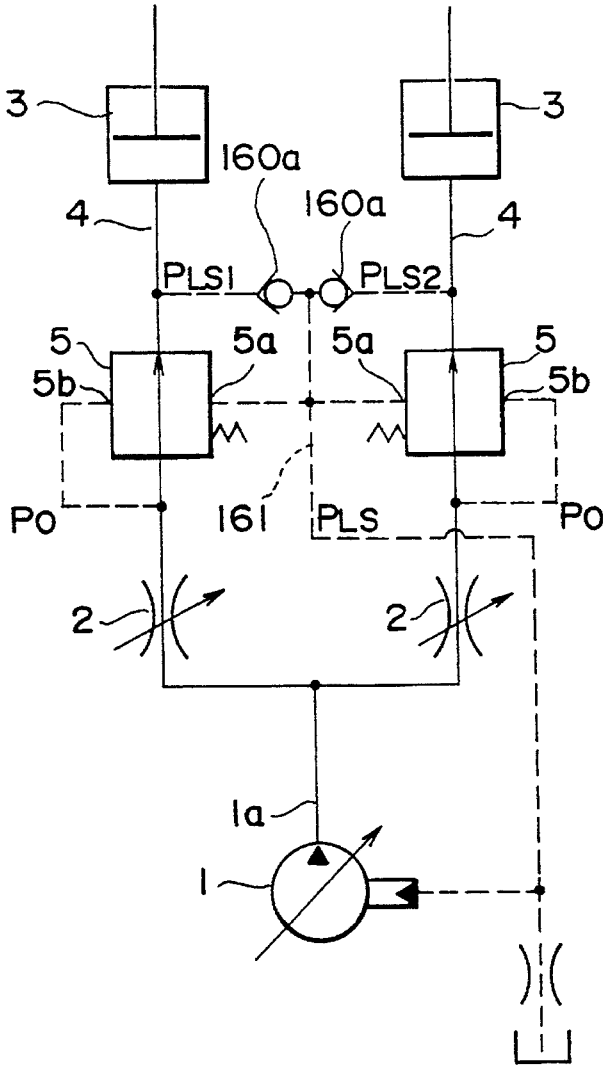
FIG. 17 (PRIOR ART)
Figure 18:
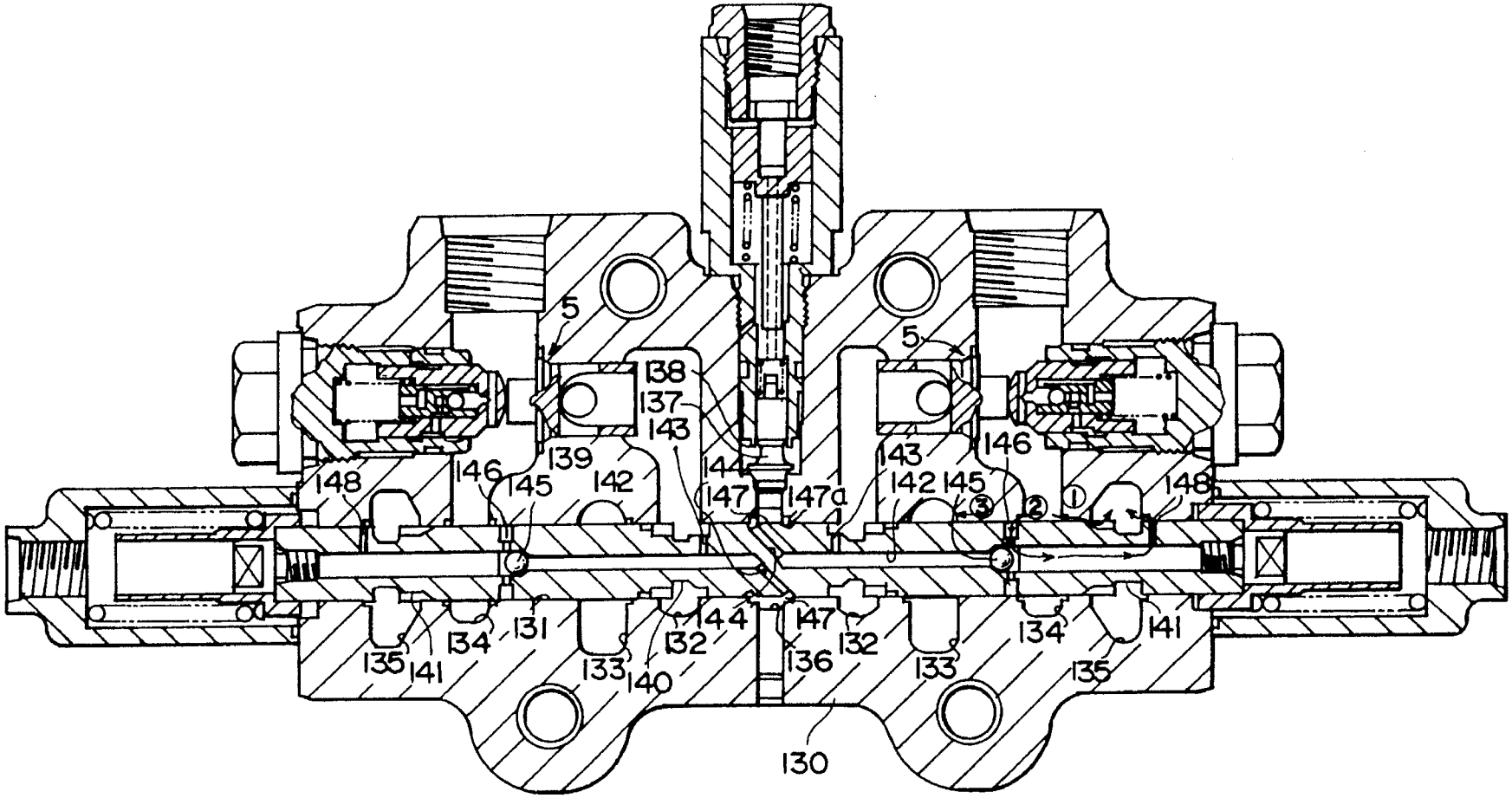
FIG. 18 (PRIOR ART)
Figure 19:
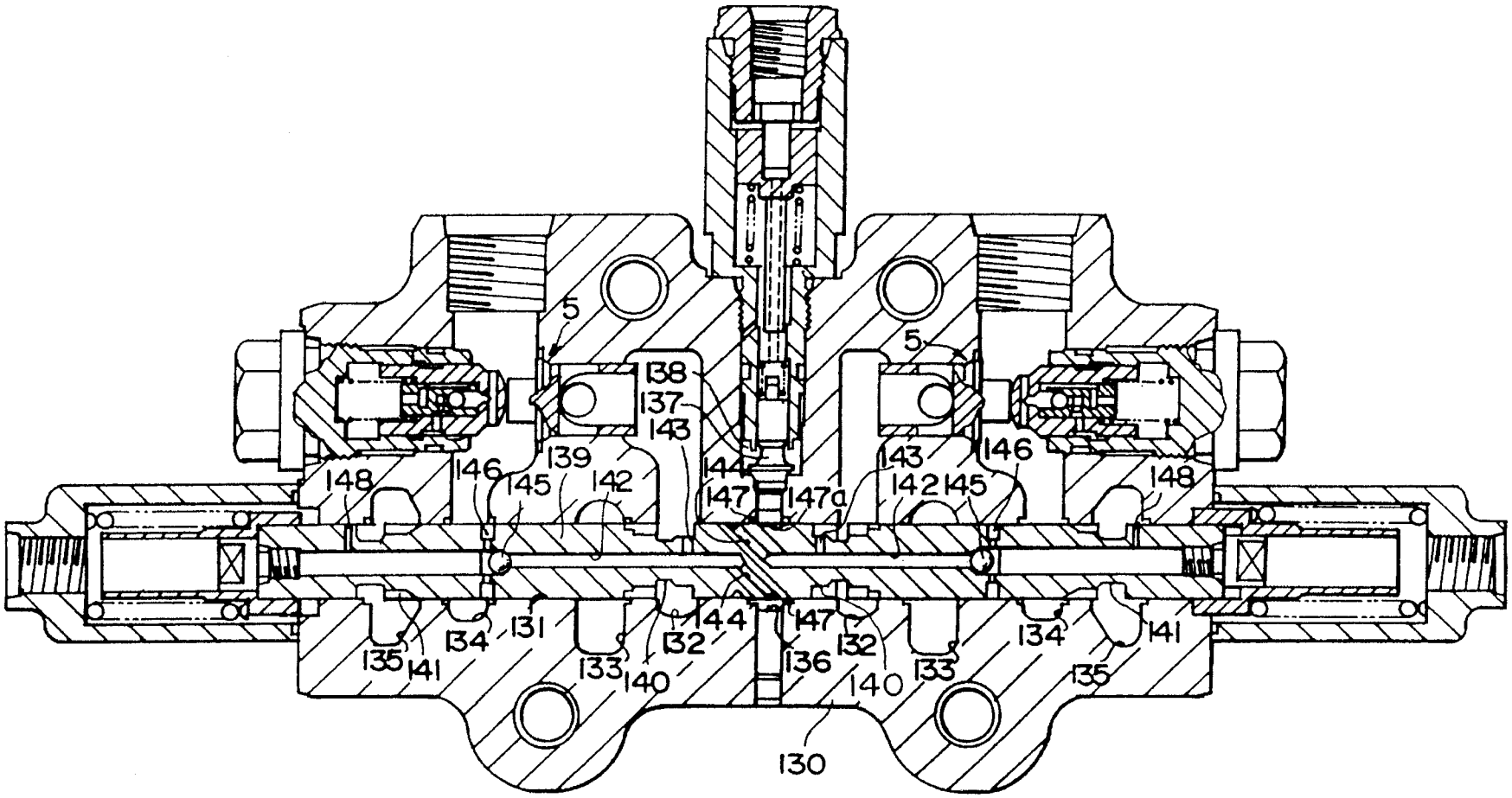
FIG. 19 (PRIOR ART)
Figure 20:
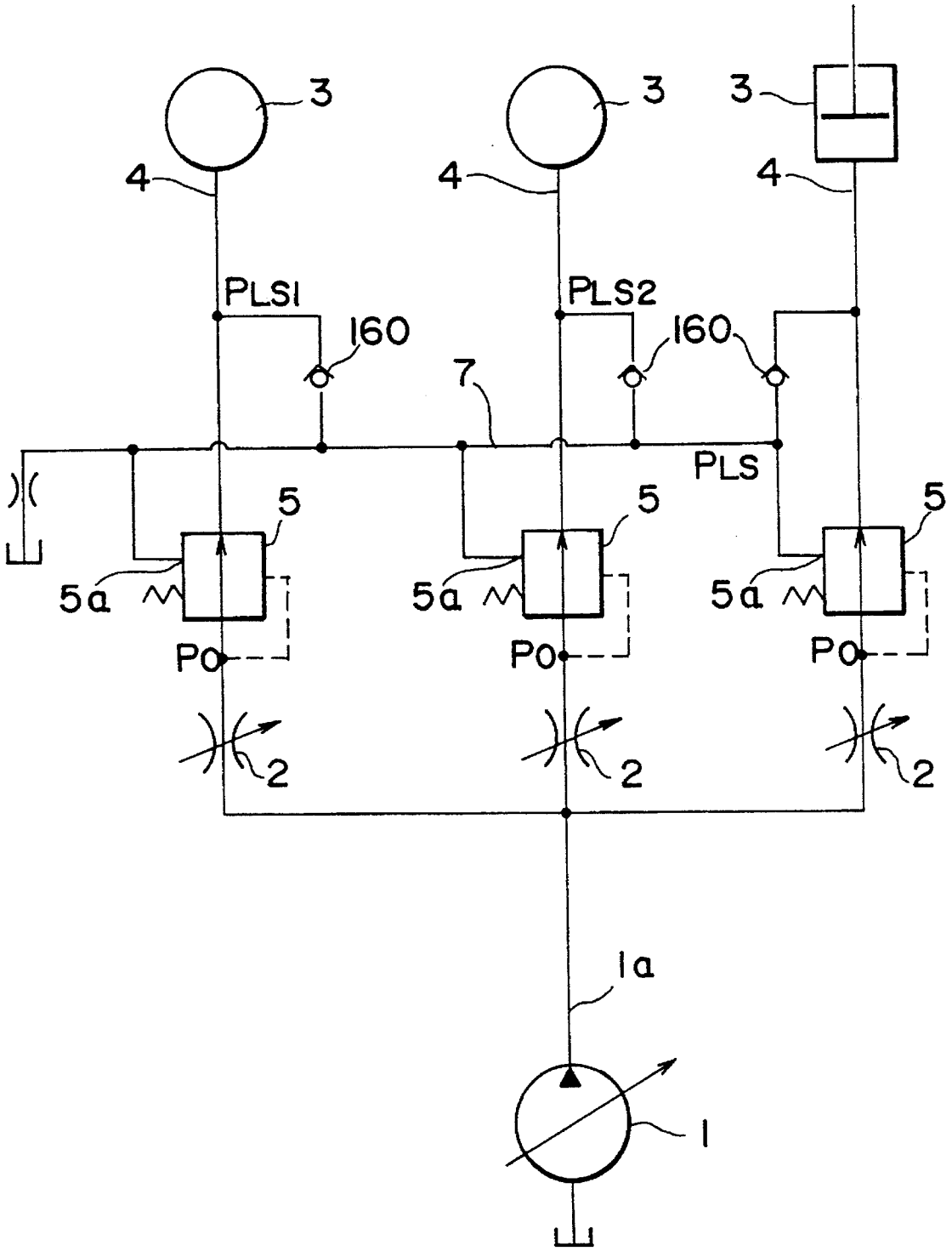
FIG. 20 (PRIOR ART)

FIG. 7, which shows the ninth embodiment of the present invention, illustrates a specific configuration which can be used as the check valves 160*a*, 160*a* in the hydraulic circuit shown in FIG. 17. An oil hole 121, which serves as a load pressure detection passage 127, is formed in a block 120, and the oil hole 121 is communicated with a plurality of load pressure detection ports 123 through the respective ports 122, each communicating section being provided with a check valve 119. The pressure $P_1$ of the oil hole 121 is compared with the pressure $P_2$ of a port 122, and, if $P_1< P_2$, the load pressure of that port 122 flows into the oil hole 121. Thus, the maximum load pressure of the load pressure detection ports 123 flows into the oil hole 121.

A check valve 124 in the check valves 119 is designed to open and close the port 122 of the load pressure detection port 123 which is connected to a particular actuator, e.g., the swinging motor. The check valve 124 comprises: a poppet 125, which opens and closes the oil hole 121 and the port 122; a spring 126, which pushes the poppet 125 in the closing direction; a piston 127, which pushes the spring 126 and the poppet 125; a balance piston 128, with which the piston 127 contacts; and a spring 129, which pushes the piston 127. The check valve 124 is designed so that, when the pressure $P_0$ of the pressurized oil supplied to a pressure receiving chamber 118 of the piston 127 exceeds a given value, the differential pressure with respect to the valve opening pressure of the poppet 125, i.e., the pressure $P_1$ of the port 122, at which the poppet 125 is released, gradually increases in proportion to the hydraulic power.

The pressurized oil is supplied to the pressure receiving chamber 118 through a valve, and the pressure thereof is gradually increased by the operation of a lever. For example, the pressurized oil of the boom pilot valve, which supplies a switching pilot pressure oil, is supplied to the pressure receiving section of the operating valve, which supplies the pressurized oil to an actuator other than the swinging motor, e.g., the boom cylinder.

Hence, when the pressurized oil is not supplied to the pressure receiving chamber 118, the valve opening pressure of the check valve 124 becomes the same as that of other check valve 119. As the pressure $P_0$ of the pressurized oil supplied to the pressure receiving chamber 118 increases, the switching valve increases gradually, causing the differential pressure between the pressure $P_1$ of the oil hole 121 when the swing load flows through the oil hole 121 and the load pressure $P_2$ to gradually increase, thus making it possible to prevent the markedly high load pressure, in the early stage of a swing, from flowing through the oil hole 121. The differential pressure between the $P_2$ and $P_1$ gradually decreases as the pressure $P_0$ of the pressurized oil of the pressure receiving chamber 118 gradually decreases, thus smoothing the pressure fluctuation in the load pressure flowing through the oil hole 121.

In the embodiments described above, the balance piston is pushed by the pressurized oil, but a proportional solenoid can be used to push it. In other words, the valve opening pressure of the check valve 124 can be gradually increased by an external signal.

Figure 8:
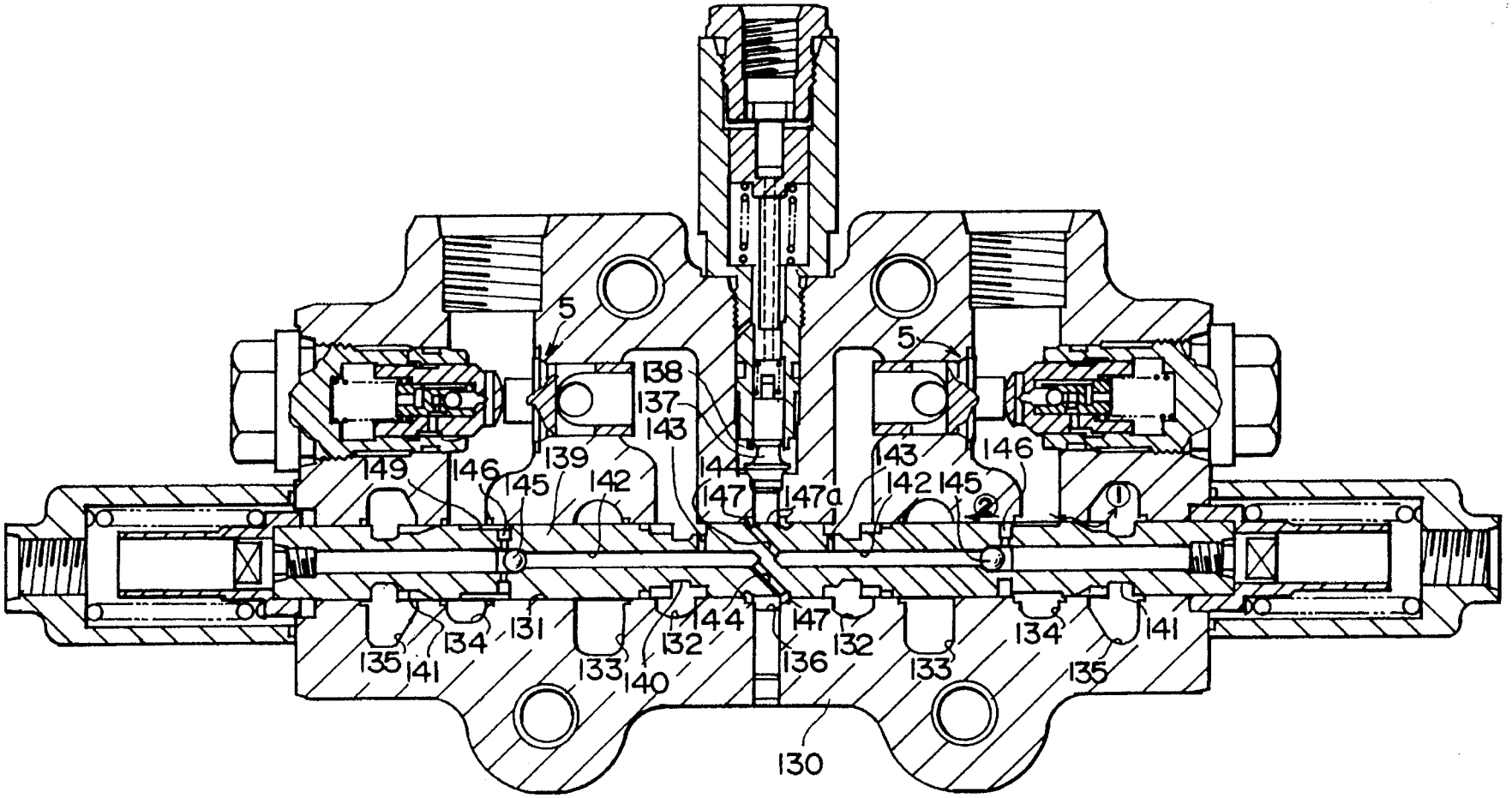
FIG. 8 is a diagram showing an eighth embodiment of the present invention, which corresponds to the fifth aspect of the invention, and showing a neutral condition.
Figure 9:
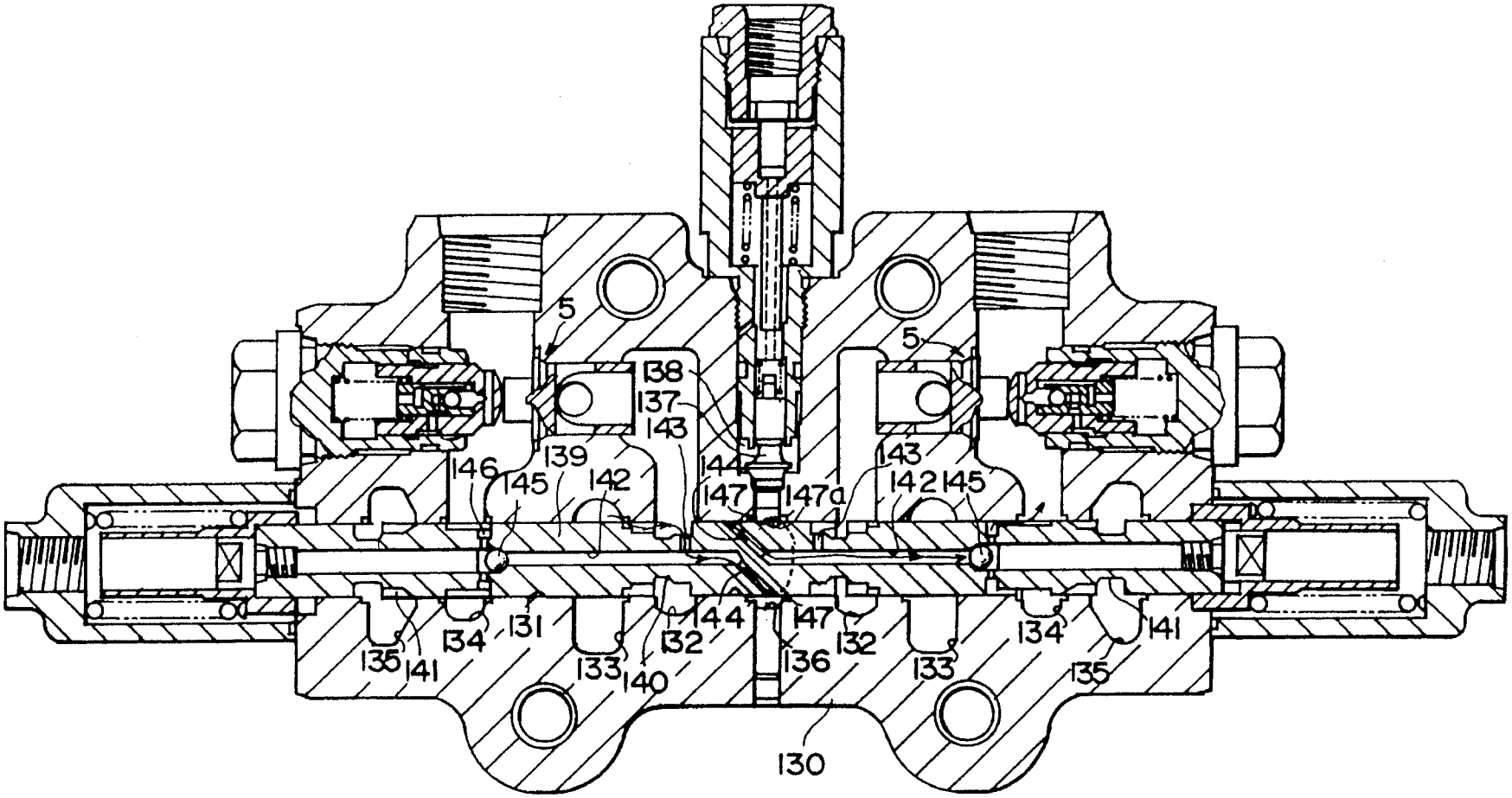
FIG. 9 is a diagram showing a condition wherein the system has been operated toward the left from the neutral condition shown in FIG. 8.

FIGS. 8 and 9, which show the ninth embodiment of the present invention, illustrate a specific configuration of the check valve 160*a* mounted on the operating valve 2 in the hydraulic circuit shown in FIG. 17. The clearance gap 149, open to the actuator port 134, is formed between the spool and the spool hole 131, with the peripheral surface, at which the third port 146 is opened and which is closer to the second small-diameter section 141, being the small diameter.

Thus, a part of the load pressure, which is detected when the spool 139 is operated as shown in FIG. 9, flows into the actuator port 134 via the clearance gap 149, and it flows out to the tank port 135 via the second small-diameter section 141 from the actuator port 134, permitting a reduction in the load pressure.

Further, when the spool 139 is set in the neutral position shown in FIG. 8, the pressurized oil in the actuator port 134 leaks to the pump port 133 and the tank port 135 through the clearance gap 149 between the spool hole 131 and the spool 139 as shown by the arrows. However, the pressurized oil flowing into the third port 146 does not leak. Therefore, the pressure oil leakage flow rate in the actuator port 134 is reduced.

Figure 10:
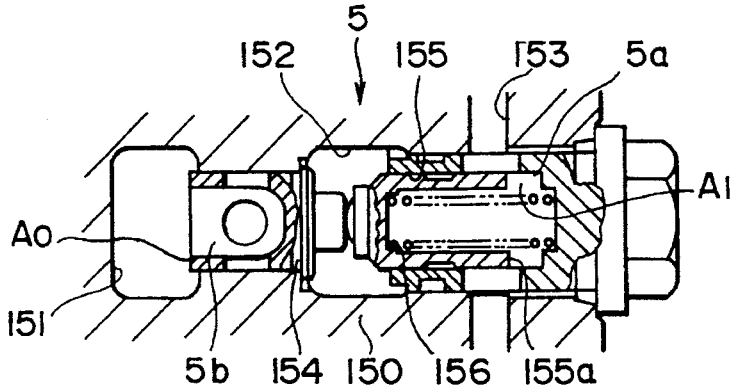
FIG. 10 is a diagram showing a ninth embodiment of the present invention which corresponds to the sixth aspect of the invention.

FIG. 10, showing the ninth embodiment of the present invention, illustrates a specific configuration which can be use as the pressure compensating valve 5 in the hydraulic circuit shown in FIG. 17 mentioned above. The pressure compensating valve 5 has an inlet port 151, an outlet port 152, and a load pressure introduction port 153 formed in a valve main body 150. The valve 5 is provided with a poppet 154, which opens and closes the inlet port 151 and the outlet port 152, and a spool 155, which pushes the poppet 154 to the closing side. The spool 155 is pushed to the closing side by a spring 156. The trailing end surface 155*a* is opened to the load pressure introduction port 153 to constitute the first pressure receiving section 5*a*. The poppet 154 is pushed to the opening side by the pressure of the inlet port 151 to provide the second pressure receiving section 5b. The area of the part on which the pressure on the inlet port side of the poppet 154 acts, i.e., a pressure receiving area $A_0$ of the second pressure receiving section 5b , is made smaller than the area of the part on which the 10 load pressure introduction port pressure of the spool 155 acts, i.e., a pressure receiving area $A_1$ of the first pressure receiving section 5a ($A_0<A_1$). This offsets the drop in the load pressure $P_{LS}$ by the difference in the pressure receiving area $A_1-A_0$ so that a rate of flow, which matches the opening of the operating valve, is supplied to the traveling motor on the braking side, enabling smooth swing and travel with a swing radius matching to the opening ratio of the two operating valves 2.

Figure 11:
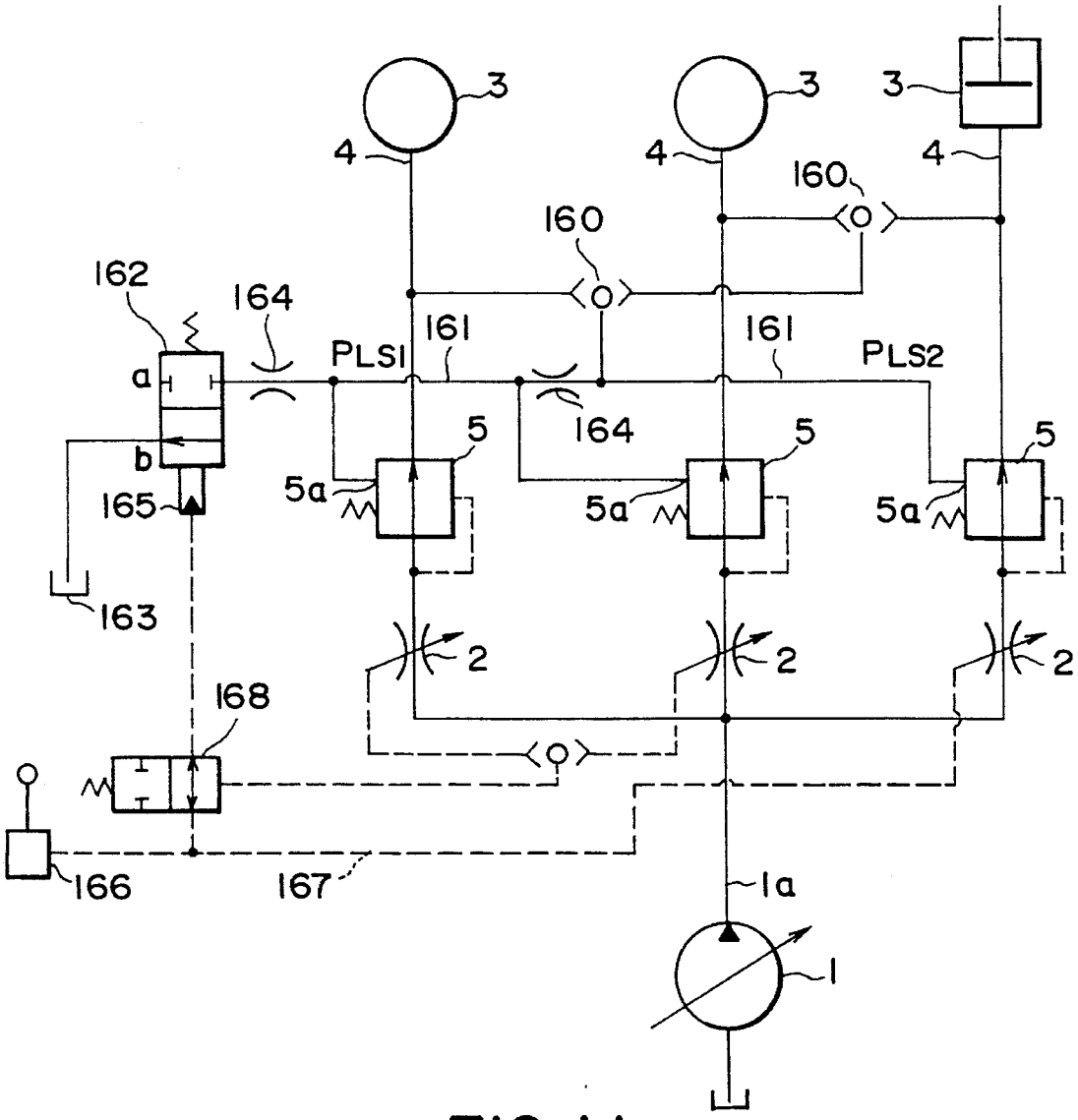
FIG. 11 is a diagram showing a tenth embodiment of the present invention which corresponds to the seventh aspect of the invention.
Figure 12:
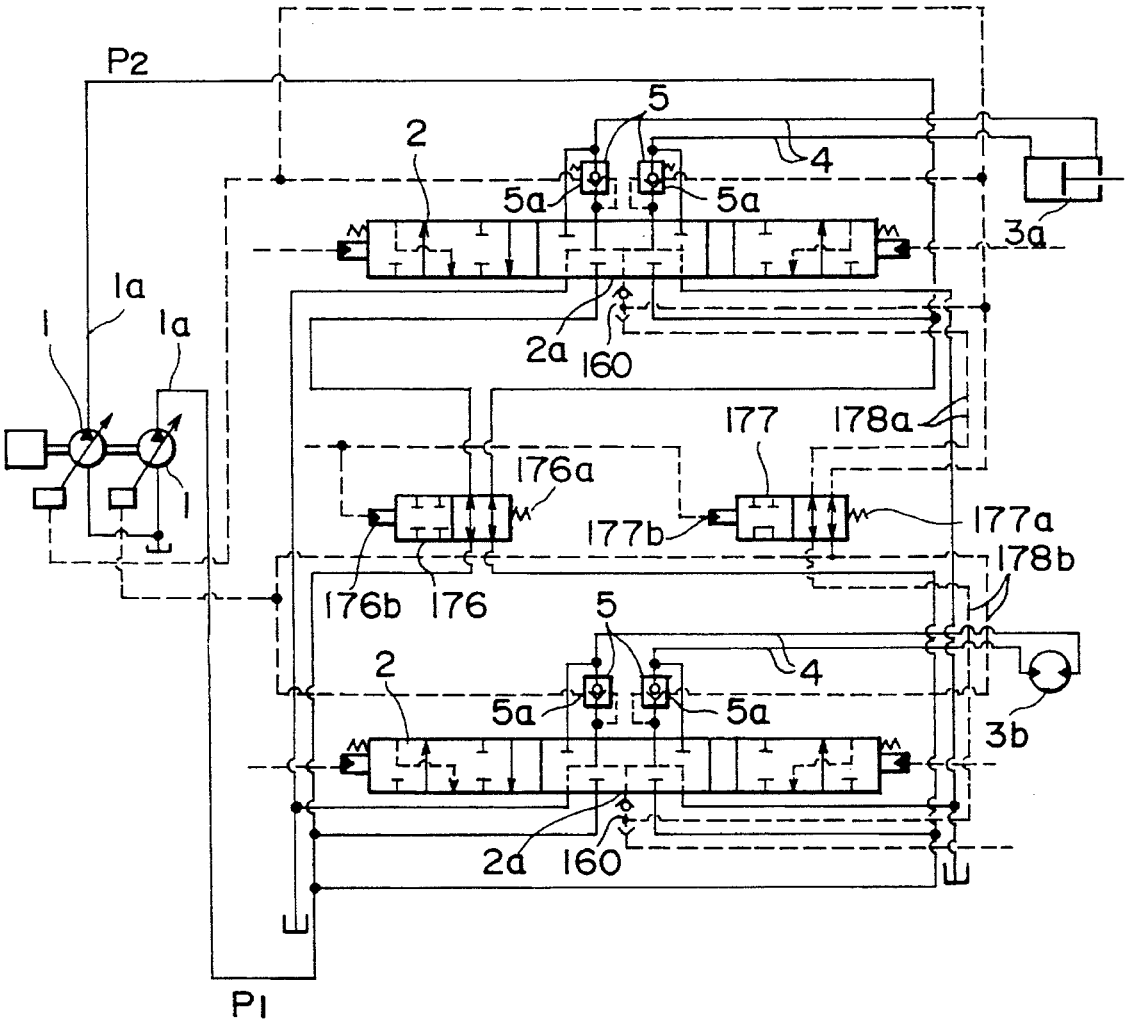
FIG. 12 (PRIOR ART)
FIG. 12 through FIG. 20 are diagrams showing the prior art.
Figure 13:
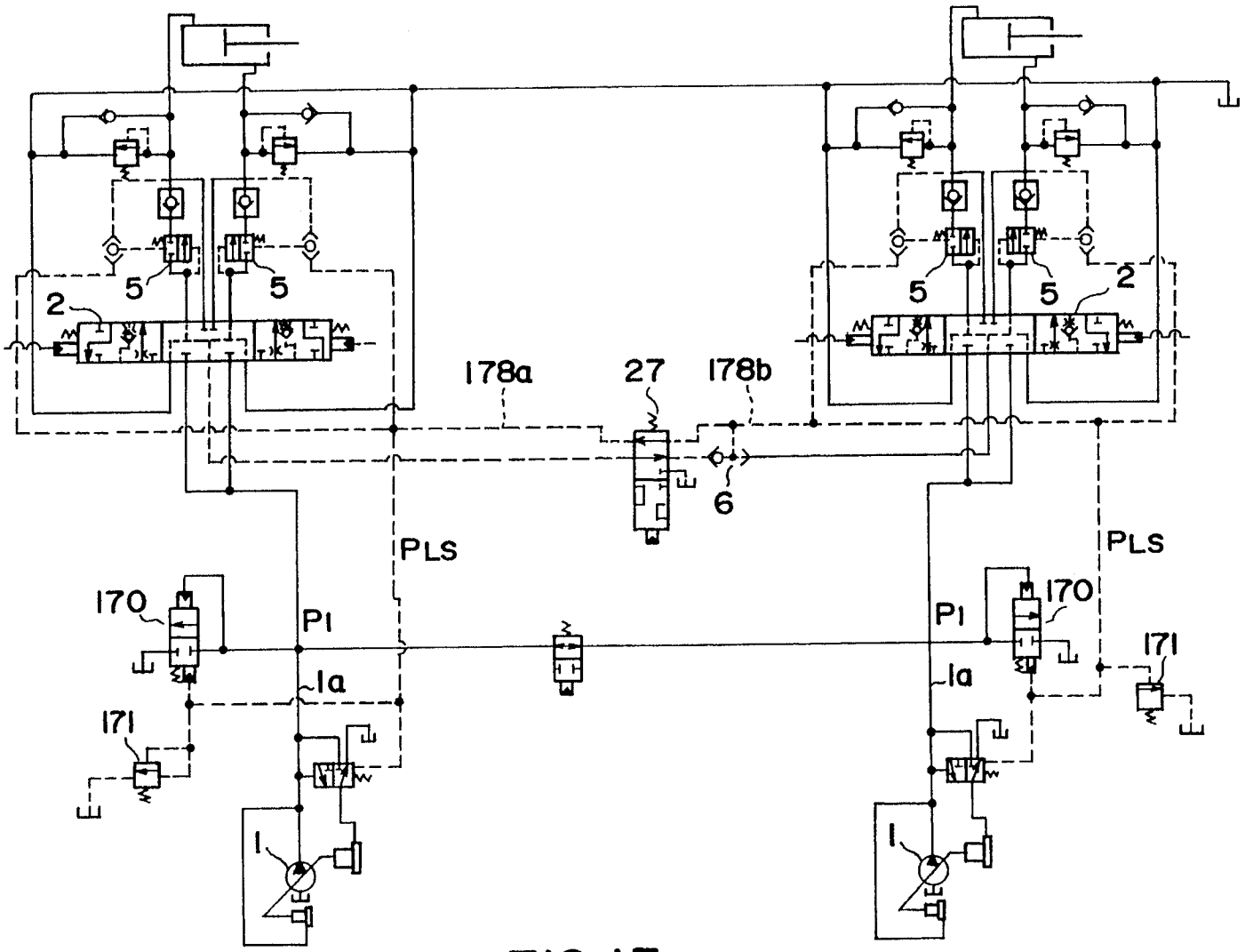
FIG. 13 (PRIOR ART)
Figure 14:
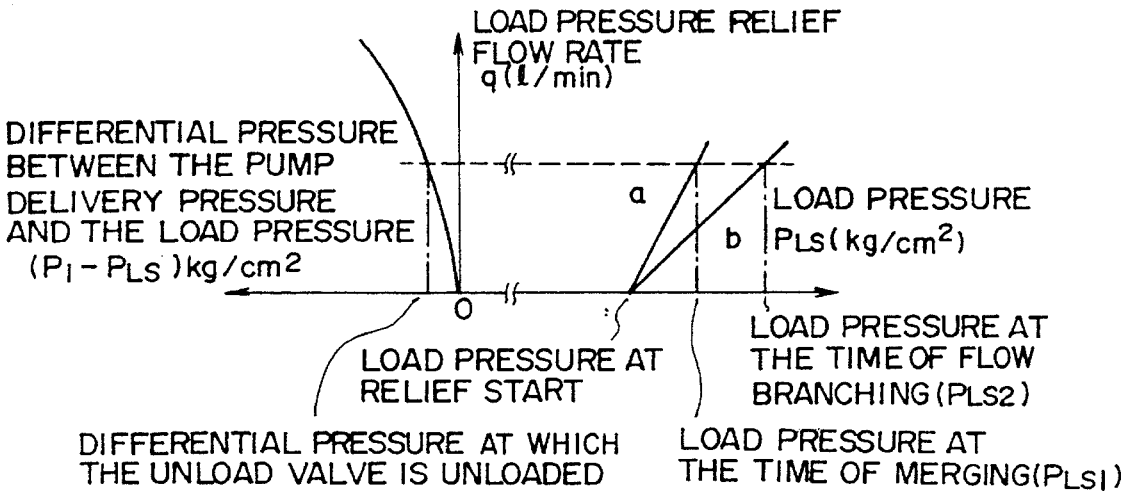
FIG. 14 (PRIOR ART)
Figure 15:
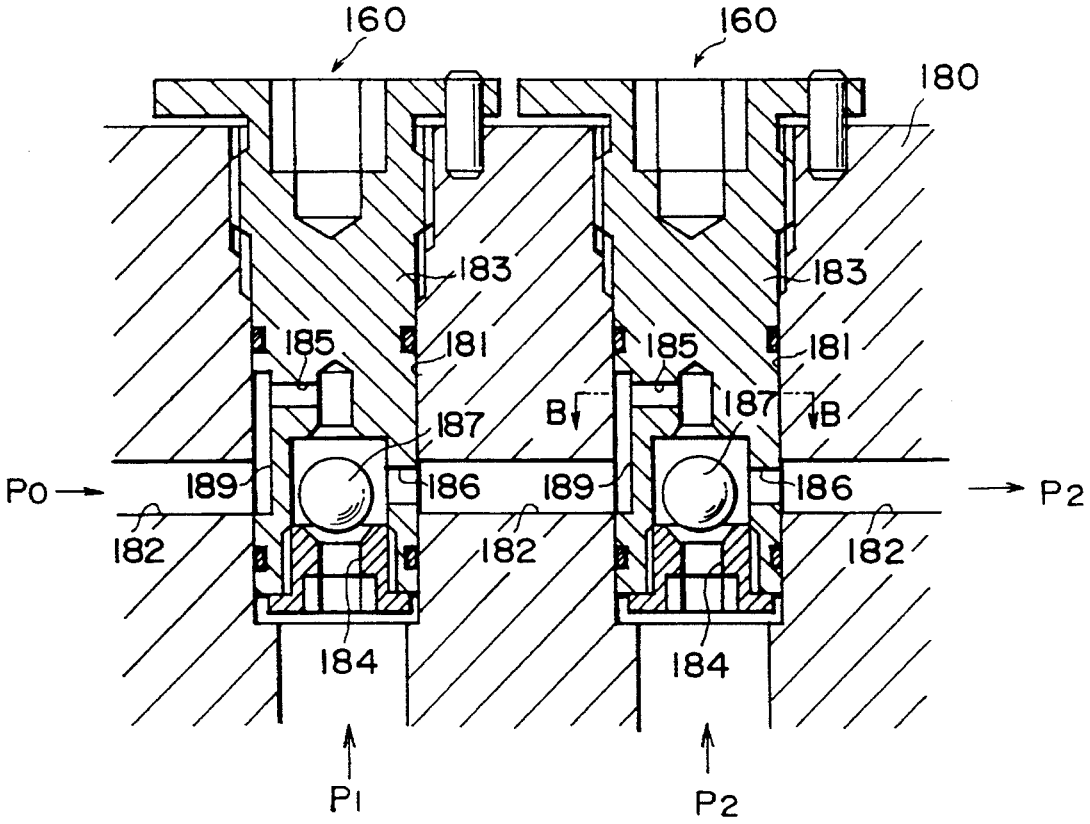
FIG. 15 (PRIOR ART)
Figure 16:
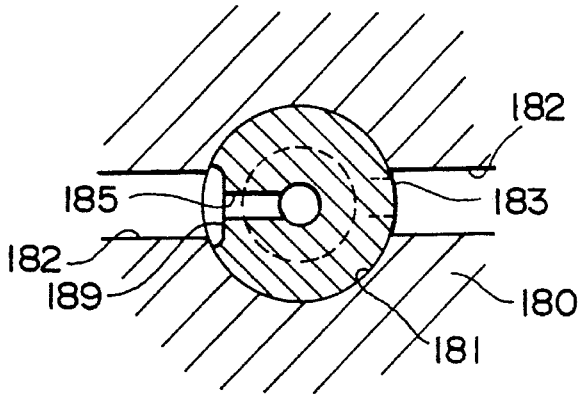
FIG. 16 (PRIOR ART)

In FIG. 11, which shows the tenth embodiment of the present invention, the load pressure detection passage 161, which is connected to the pressure receiving sections 5a, 5a of the pressure compensating valves 5, 5 provided in the circuits 4, 4 of the two left hydraulic actuators 3, 3, which are the traveling motors, is allowed to be communicated with or shut off from a tank 163 by a valve 162. The inflow side of the valve 162 and the load pressure detection passage 161, which is connected to the pressure receiving section 5a of the pressure compensating valve 5 provided in the circuit 4 of the right hydraulic actuator 3, which is the boom cylinder, are provided with restrictors 164. The valve 162 is held in its shutoff position a by a spring force, and it is set in its communicating position b by the pressurized oil acting on a pressure receiving section 165, the pressure receiving section 165 being connected to an output passage 167 of a pilot control valve 166, which switches the right operating valve 2, via a switching valve 168. The switching valve 168 is designed so that it is set in its shutoff position by a spring force or in its communicating position by the pilot pressure which switches the left two hydraulic actuators 3, 3.

In the embodiment described above, the circuits 4 are connected through the shuttle valves 160 to detect the maximum load pressure at the load pressure detection passages 161, but check valves can be used in place of the shuttle valves 160.

Industrial Applicability

The present invention, which is effective as a hydraulic circuit for simultaneous operation in a hydraulic excavating machine or the like, is capable of supplying the delivery pressure oil of a single pump or a plurality of pumps to a plurality of actuators, and distributing the delivery pressure oil of the pump or pumps in accordance with the opening of respective operating valves or a pressure compensating valve. A maximum load pressure detector is designed to select the maximum load pressure among the load pressures of a plurality of actuators in the hydraulic circuit or the like and to use it as a pilot pressure for controlling the discharge of the pump or pumps or the pressure compensating valve.

What is claimed is:

1. A hydraulic circuit for operating a plurality of actuators, said hydraulic circuit comprising:

said plurality of actuators;

a plurality of hydraulic pumps, each of said plurality of hydraulic pumps having a delivery passage and a tiltable swash plate;

a plurality of pressure compensating valves;

a plurality of operating valves, each of said plurality of operating valves being connected for passing pressurized hydraulic fluid from at least one of said plurality of hydraulic pumps through a respective one of said pressure compensating valves to a respective one of said actuators;

a plurality of load pressure introduction conduits, each of said plurality of load pressure introduction conduits detecting a load pressure of a respective one of the plurality of operating valves and feeding the thus detected load pressure back to a pressure compensating valve associated with the respective one of the plurality of operating valves;

a plurality of load sensing valves, each of said load sensing valves controlling the tilt of the swash plate of a respective one of the plurality of hydraulic pumps;

a load pressure relief valve which is connected to the load pressure introduction conduits and which has a variable set pressure;

a plurality of main relief valves, each of said main relief valves being provided in the delivery passage of a respective one of the plurality of hydraulic pumps and having a higher set pressure than the set pressure of said load pressure relief valve; and means for varying the set pressure of the load pressure relief valve.

2. A hydraulic circuit in accordance with claim 1, wherein said load pressure relief valve has a pressure receiving chamber, and wherein said means for varying the set pressure of the load pressure relief valve comprises a solenoid valve, a controller for operating said solenoid valve, and a selector switch for applying a signal to said controller, whereby said controller operates said solenoid valve to pass hydraulic fluid to the pressure receiving chamber of said load pressure relief valve when said selector switch is actuated.

3. A hydraulic circuit in accordance with claim 2, wherein said hydraulic circuit further comprises:

a first flow merging and branching valve having a first position for merging the flows of pressurized hydraulic fluid from at least two of said plurality of hydraulic pumps and a second position for branching the flows of pressurized hydraulic fluid from said at least two of said plurality of hydraulic pumps;

a second flow merging and branching valve having a first position for merging the flows of at least two of the plurality of load pressure introduction conduits and a second position for branching the flows of said at least two of the plurality of load pressure introduction conduits;

a plurality of first check valves;

a first short-circuit passage which communicates with the delivery passage of each of said at least two of said plurality of hydraulic pumps through a respective one of said first check valves;

a plurality of second check valves; and a second short-circuit passage which communicates with each of said at least two of the plurality of load pressure introduction conduits through a respective one of said second check valves;

wherein said load pressure relief valve is installed in the second short-circuit passage.

4. A hydraulic circuit in accordance with claim 3, wherein said hydraulic circuit further comprises:

an unload valve which is installed in the first short-circuit passage and which is unloaded in response to a difference between a pressure in the first short-circuit passage and a pressure in the second short-circuit passage.

5. A hydraulic circuit for operating a plurality of actuators, said hydraulic circuit comprising:

a plurality of hydraulic pumps, each of said plurality of hydraulic pumps having a delivery passage;

a plurality of pressure compensating valves;

a plurality of operating valves, each of said plurality of operating valves being connected for passing pressurized hydraulic fluid from at least one of said plurality of hydraulic pumps through a respective one of said pressure compensating valves to a respective one of said actuators;

a plurality of load pressure introduction conduits, each of said plurality of load pressure introduction conduits detecting a load pressure of a respective one of the plurality of operating valves and feeding the thus detected load pressure back to a pressure compensating valve associated with the respective one of the plurality of operating valves;

a first flow merging and branching valve having a first position for merging the flows of pressurized hydraulic fluid from at least two of said plurality of hydraulic pumps and a second position for branching the flows of pressurized hydraulic fluid from said at least two of said plurality of hydraulic pumps;

a second flow merging and branching valve having a first position for merging the flows of at least two of the plurality of load pressure introduction conduits and a second position for branching the flows of said at least two of the plurality of load pressure introduction conduits;

a plurality of first check valves;

a first short-circuit passage which communicates with the delivery passage of each of said at least two of said plurality of hydraulic pumps through a respective one of said first check valves;

a plurality of second check valves;

a second short-circuit passage which communicates with each of said at least two of the plurality of load pressure introduction conduits through a respective one of said second check valves;

a relief valve which is installed in the second short-circuit passage; and an unload valve which is installed in the first short-circuit passage and which is unloaded in response to a difference between a pressure in the first short-circuit passage and a pressure in the second short-circuit passage.

6. A hydraulic circuit in accordance with claim 5, wherein said relief valve has a fixed set pressure.

7. A maximum load pressure detector comprising:

an operating valve main body having a first surface;

a plurality of pressure detection ports and a maximum pressure detection port formed in said operating valve main body and opened to said first surface of the operating valve main body;

a shuttle valve mounting block having a mounting surface attached to said first surface of the operating valve main body;

a pressure introduction port, a plurality of charging holes, and a pressure take-out port formed in said shuttle valve mounting block and opened to said mounting surface, with said pressure introduction port being open to a first one of said plurality of pressure detection ports, with a first one of said plurality of charging holes being open to a second one of said plurality of pressure detection ports, with a second one of said plurality of charging holes being open to a third one of said plurality of pressure detection ports, and with said pressure take-out port being open to said maximum pressure detection port;

a sealing material provided at the joint between said first surface of the operating valve main body and said mounting surface of the shuttle valve mounting block to seal all of the ports;

a first slant communicating hole formed in said shuttle valve mounting block at a slant angle to said mounting surface to provide communication between the pressure introduction port and a distal end of a first one of said plurality of charging holes;

a second slant communicating hole formed in said shuttle valve mounting block at a slant angle to said mounting surface to provide communication between an intermediate portion of one of said plurality of charging holes and a distal end of an adjacent one of said plurality of charging holes;

a third slant communicating hole formed in said shuttle valve mounting block at a slant angle to said mounting surface to provide communication between an intermediate portion of said adjacent one of said plurality of charging holes and said pressure take-out port;

a plurality of lower seats, each of said lower seats having an inlet port and being fitted in a respective one of said plurality of charging holes adjacent to said mounting surface; and a plurality of balls, each of said balls being positioned in a respective one of said plurality of charging holes between a lower seat and a distal end of the respective charging hole so as to constitute a shuttle valve.

8. A maximum load pressure detector in accordance with claim 7, wherein said plurality of charging holes consists of two charging holes; wherein said second slant communicating hole provides communication between an intermediate portion of said first one of said plurality of charging holes and a distal end of said second one of said plurality of charging holes; and wherein said third slant communicating hole provides communication between an intermediate portion of said second one of said plurality of charging holes and said pressure take-out port.

9. A maximum load pressure detector in accordance with claim 7, further comprising a plurality of upper seats, each of said upper seats being fitted in a respective one of said plurality of charging holes with a respective one of said plurality of balls being positioned between a lower seat and an upper seat, each of said upper seats having an inlet port open to the distal end of the respective charging hole.

10. A maximum load pressure detector in accordance with claim 9, wherein each of said plurality of charging holes comprises a large diameter hole adjacent to said mounting surface and a smaller diameter hole positioned between the large diameter hole and the distal end of the respective one of said plurality of charging holes, with each lower seat being press-fitted in a respective large diameter hole and each upper seat being press-fitted in a respective smaller diameter hole.

11. A maximum load pressure detector in accordance with claim 9, wherein each of said upper seats has an outlet port at an intermediate portion of the respective charging hole for communication with a respective one of the slant communicating holes.

12. A maximum load pressure detector comprising:

an operating valve main body having a first surface;

a plurality of pressure detection ports and a maximum pressure detection port formed in said operating valve main body and opened to said first surface of the operating valve main body;

a shuttle valve mounting block having a mounting surface attached to said first surface of the operating valve main body;

a pressure introduction port, a plurality of charging holes, and a pressure take-out port formed in said shuttle valve mounting block and opened to said mounting surface, with said pressure introduction port being open to a first one of said plurality of pressure detection ports, with a first one of said plurality of charging holes being open to a second one of said plurality of pressure detection ports, with a second one of said plurality of charging holes being open to a third one of said plurality of pressure detection ports, and with said pressure take-out port being open to said maximum pressure detection port;

a sealing material provided at the joint between said first surface of the operating valve main body and said mounting surface of the shuttle valve mounting block to seal all of the ports;

a first slant communicating hole formed in said shuttle valve mounting block at a slant angle to said mounting surface to provide communication between the pressure introduction port and an intermediate portion of a first one of said plurality of charging holes;

a second slant communicating hole formed in said shuttle valve mounting block at a slant angle to said mounting surface to provide communication between a distal end of one of said plurality of charging holes and an intermediate portion of an adjacent one of said plurality of charging holes;

a third slant communicating hole formed in said shuttle valve mounting block at a slant angle to said mounting surface to provide communication between a distal end of said adjacent one of said plurality of charging holes and said pressure take-out port;

a plurality of seats, each of said seats having an inlet port and being fitted in a respective one of said plurality of charging holes adjacent to said mounting surface; and a plurality of balls, each of said balls being positioned in a respective one of said plurality of charging holes between a seat and a distal end of the respective charging hole so as to constitute a shuttle valve.

13. A maximum load pressure detector comprising:

an operating valve main body having a first surface and being provided with a plurality of charging holes which open to said first surface, said operating valve main body having a plurality of pressure detection ports, with each pressure detection port being open to a bottom portion of a respective one of the plurality of charging holes;

a plurality of shuttle valve main bodies, each shuttle valve main body being fitted in a respective one of the plurality of charging holes to constitute a shuttle valve;

each shuttle valve main body having an upper inlet port, a lower inlet port, and a middle outlet port and incorporating a ball which selectively opens the middle outlet port to one of the upper inlet port and the lower inlet port, each lower inlet port being opened to a respective pressure detection port;

each shuttle valve having an upper annular space formed between an upper portion of a respective charging hole and an associated shuttle valve main body, with each upper inlet port being opened to an upper annular space;

each shuttle valve having a lower annular space formed between a lower portion of a respective charging hole and an associated shuttle valve main body, with each middle outlet port being opened to a lower annular space;

a plurality of communicating holes formed in said operating valve main body aslant to said first surface, each of said communicating holes providing communication between an upper annular space of one of said shuttle valves and a lower annular space of an adjacent one of said shuttle valves;

a pressure take-out port formed in said operating valve main body and being opened to the lower annular space of an endmost shuttle valve;

a first sealing material positioned between each charging hole and the associated shuttle valve to provide a seal between the respective pressure detection port and the lower annular space of the respective shuttle valve; and a second sealing material positioned between each charging hole and the associated shuttle valve to provide a seal between the lower annular space and the upper annular space of the respective shuttle valve.

14. A maximum load pressure detector in accordance with claim 13, wherein a portion of each charging hole is threaded, and wherein a portion of each shuttle valve main body is threaded for engagement with the threaded portion of the respective charging hole.

15. A maximum load pressure detector in accordance with claim 13, wherein each shuttle valve main body has an outwardly extending flange at its upper end, and further comprising bolts securing said flange to said first surface of the valve main body.

16. A hydraulic circuit for operating a plurality of actuators, said hydraulic circuit comprising:

a plurality of hydraulic pumps, each of said plurality of hydraulic pumps having a delivery passage;

a plurality of pressure compensating valves, each of said pressure compensating valves having a pressure receiving section;

a plurality of operating valves, each of said plurality of operating valves being connected for passing pressurized hydraulic fluid from at least one of said plurality of hydraulic pumps through a respective one of said pressure compensating valves to a respective one of said actuators;

a plurality of load pressure introduction conduits, each of said plurality of load pressure introduction conduits detecting a load pressure of a respective one of the plurality of operating valves and feeding the thus detected load pressure back to a pressure compensating valve associated with the respective one of the plurality of operating valves;

a plurality of check valves; and a load pressure detecting passage connected to each of the plurality of load pressure introduction conduits by a respective one of said plurality of check valves, said load pressure detecting passage being connected to the pressure receiving sections of the pressure compensating valves;

whereby each check valve compares the pressure of the load pressure detecting passage with the pressure of the associated load pressure introduction conduit and if the pressure of the load pressure detecting passage is less than the pressure of the associated load pressure introduction conduit then the load pressure of the associated load pressure introduction conduit flows into the load pressure detecting passage, so that the maximum load pressure of the load pressure introduction conduits flows into the load pressure detecting passage;

wherein a particular one of said plurality of check valves is connected to a particular actuator, said particular one of said plurality of check valves being adapted so that the value of differential pressure at which it opens can be varied by an external signal.

17. A hydraulic circuit in accordance with claim 16, wherein said particular one of said plurality of check valves comprises:

a poppet having an opened position which provides communication between the load pressure detection passage and a load pressure introduction conduit which is connected to said particular actuator, and a closed position which prevents communication between the load pressure detection passage and said load pressure introduction conduit which is connected to said particular actuator;

a spring which pushes the poppet towards said closed position;

a first piston which pushes the spring and the poppet, said first piston having a pressure receiving chamber;

a balance piston which contacts the first piston; and a spring which pushes the first piston, so that, when the pressure of a fluid supplied to the pressure receiving chamber of the first piston exceeds a given value, the differential pressure with respect to the valve opening pressure of the poppet gradually increases in proportion to the pressure of the fluid supplied to the pressure receiving chamber of the first piston.

18. A hydraulic circuit in accordance with claim 17, further comprising a conduit for passing hydraulic fluid to the pressure receiving chamber of the first piston and incorporating a control valve, and a lever for operating said control valve.

19. A pressure compensated hydraulic circuit for operating a plurality of actuators, said hydraulic circuit comprising:

said plurality of actuators;

a plurality of hydraulic pumps, each of said plurality of hydraulic pumps having a delivery passage;

a plurality of pressure compensating valves, each of said plurality of pressure compensating valves having a pressure receiving section;

a plurality of operating valves, each of said plurality of operating valves being connected for passing pressurized hydraulic fluid from at least one of said plurality of hydraulic pumps through a respective one of said pressure compensating valves to a respective one of said actuators;

a plurality of load pressure introduction conduits, each of said plurality of load pressure introduction conduits detecting a load pressure of a respective one of the plurality of operating valves and feeding the thus detected load pressure back to a pressure compensating valve associated with the respective one of the plurality of operating valves;

a plurality of check valves;

a load pressure detecting passage connected to each of the plurality of load pressure introduction conduits by a respective one of said plurality of check valves, said load pressure detecting passage being connected to the pressure receiving sections of the pressure compensating valves;

wherein each said operating valve comprises a valve main body and a valve spool;

wherein said valve main body has a spool passage formed therein with said spool passage having a right end portion and a left end portion;

wherein said valve spool is positioned in said spool passage;

wherein said valve main body has a right output port, a right pump port, a right actuator port, a right tank port, and a right load pressure detection port formed in said right end portion; a left output port, a left pump port, a left actuator port, a left tank port, and a left load pressure detection port formed in said left end portion; and a load pressure detection port formed at a midpoint of the spool passage;

wherein said valve spool has a left end portion having a first left small-diameter section and a second left small-diameter section, and a right end portion having a first right small-diameter section and a second right small-diameter section;

wherein said valve spool has a left load pressure detection passage and first, second, and third left port passages formed in the left end portion of said valve spool, and a right load pressure detection passage and first, second, and third right port passages formed in the right end portion of said valve spool;

wherein said valve spool has a left reduced diameter portion forming a left clearance gap which opens to the left actuator port;

wherein said valve spool has a right reduced diameter portion forming a right clearance gap which opens to the right actuator port;

wherein said left load pressure detection passage contains a left check valve at one end thereof;

wherein said right load pressure detection passage contains a right check valve at one end thereof;

wherein said first left port passage in said valve spool provides communication between the left load pressure detection passage and the first left small-diameter section;

wherein said second left port passage in said valve spool provides communication between the left load pressure detection passage and the load pressure detection port;

wherein said third left port passage in said valve spool provides communication between the left load pressure detection passage and the left actuator port via the left check valve and the left clearance gap;

wherein said first right port passage in said valve spool provides communication between the right load pressure detection passage and the first right small-diameter section;

wherein said second right port passage in said valve spool provides communication between the right load pressure detection passage and the load pressure detection port;

wherein said third right port passage in said valve spool provides communication between the right load pressure detection passage and the right actuator port via the right check valve and the right clearance gap;

whereby the second left port passage and the second right port passage open to the load pressure detection port when the spool moves laterally by a fine stroke.

20. A pressure compensated hydraulic circuit for operating a plurality of actuators, said hydraulic circuit comprising:

said plurality of actuators;

a plurality of hydraulic pumps, each of said plurality of hydraulic pumps having a delivery passage;

a plurality of pressure compensating valves, each of said plurality of pressure compensating valves having first and second pressure receiving sections;

a plurality of operating valves, each of said plurality of operating valves being connected for passing pressurized hydraulic fluid from at least one of said plurality of hydraulic pumps through a respective one of said pressure compensating valves to a respective one of said actuators;

a plurality of load pressure introduction conduits, each of said plurality of load pressure introduction conduits detecting a load pressure of a respective one of the plurality of operating valves and feeding the thus detected load pressure back to a pressure compensating valve associated with the respective one of the plurality of operating valves;

a plurality of check valves;

a load pressure detecting passage connected to each of the plurality of load pressure introduction conduits by a respective one of said plurality of check valves, said load pressure detecting passage being connected to the first pressure receiving sections of the pressure compensating valves;

wherein each said pressure compensating valve is shaped so that it is pressed toward its closing side by the load pressure acting on the first pressure receiving section and pressed toward its opening side by the inlet pressure acting on the second pressure receiving section, with the first pressure receiving section having a pressure receiving area which is larger than a pressure receiving area of the second pressure receiving section.

21. A pressure compensated hydraulic circuit in accordance with claim 20, wherein each said pressure compensating valve comprises:

a valve main body having an inlet port, an outlet port, and a load pressure introduction port formed therein;

a poppet which opens and closes the inlet port and the outlet port;

a spool which contacts the poppet;

a spring which pushes the spool to move the poppet toward its closing side;

wherein said spool has a trailing end surface opened to the load pressure introduction port to constitute the first pressure receiving section;

wherein the poppet has a surface exposed to pressure of the inlet port so that the poppet is pushed toward its opening side by the pressure of the inlet port, the thus exposed surface of the poppet providing the second pressure receiving section.

22. A pressure compensated hydraulic circuit for operating a plurality of actuators, said hydraulic circuit comprising:

said plurality of actuators;

a plurality of hydraulic pumps, each of said plurality of hydraulic pumps having a delivery passage;

a plurality of pressure compensating valves, each of said plurality of pressure compensating valves having a pressure receiving section;

a plurality of operating valves, each of said plurality of operating valves being connected for passing pressurized hydraulic fluid from at least one of said plurality of hydraulic pumps through a respective one of said pressure compensating valves to a respective one of said actuators;

a plurality of load pressure introduction conduits, each of said plurality of load pressure introduction conduits detecting a load pressure of a respective one of the plurality of operating valves;

a plurality of load valves;

a first load pressure detecting passage connected to a plurality of load pressure introduction conduits by said plurality of load valves, said first load pressure detecting passage being connected to the pressure receiving section of a first one of the pressure compensating valves, said first one of the pressure compensating valves being associated with a first one of the plurality of hydraulic actuators; and a second load pressure detecting passage connected by a first restrictor to said first load pressure detecting passage and to the pressure receiving section of each of the pressure compensating valves other than said first one of the pressure compensating valves; and means for determining when hydraulic fluid is supplied to said first one of said plurality of hydraulic actuators and for decreasing load pressure acting on a pressure receiving section of a pressure compensating valve associated with the remaining ones of said plurality of hydraulic actuators when hydraulic fluid is supplied to said first one of said plurality of hydraulic actuators.

23. A pressure compensated hydraulic circuit in accordance with claim 22, wherein said means comprises a relief valve, a second restrictor, and a lever for controlling the operating valve associated with said first one of said plurality of hydraulic actuators, said relief valve being connected through said second restrictor to said second load pressure detecting passage, whereby said relief valve is actuated to its open position in response to an operation of said lever.

* * * * *